US006564480B1

(12) United States Patent
Tomita et al.

(10) Patent No.: US 6,564,480 B1
(45) Date of Patent: May 20, 2003

(54) WORKING APPARATUS FOR CONSTRUCTION MACHINE

(75) Inventors: Sadahisa Tomita, Niihari-gun (JP); Genroku Sugiyama, Inashiki-gun (JP); Masakazu Haga, Niihari-gun (JP); Ryohei Suzuki, Niihari-gun (JP); Toshio Hasegawa, Higashiibaraki-gun (JP); Koji Tahara, Shimodate (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 185 days.

(21) Appl. No.: 09/722,566

(22) Filed: Nov. 28, 2000

Related U.S. Application Data

(63) Continuation of application No. PCT/JP00/01997, filed on Mar. 30, 2000.

(30) Foreign Application Priority Data

| | | |
|---|---|---|
| Mar. 30, 1999 | (JP) | 11-088797 |
| Mar. 30, 1999 | (JP) | 11-088798 |
| Apr. 21, 1999 | (JP) | 11-113794 |

(51) Int. Cl.[7] ..... E02F 9/26
(52) U.S. Cl. ..... 37/348; 414/699

(58) Field of Search ..... 37/906, 413, 348, 37/347; 414/698, 699; 33/1 N, 1 PT; E02F 9/24, 9/26, 9/20

(56) References Cited

U.S. PATENT DOCUMENTS 5,657,544 A * 8/1997 Ota et al. ..... 33/1 N

FOREIGN PATENT DOCUMENTS

| | | |
|---|---|---|
| JP | 56-81504 | * 5/1984 |
| JP | 3-106406 | 11/1991 |
| JP | 8-260525 | 10/1996 |
| JP | 2000-170217 | * 6/2000 |
| JP | 2001-330022 | * 11/2001 |

* cited by examiner

*Primary Examiner*—Robert E. Pezzuto
*Assistant Examiner*—Meredith Petravick
(74) *Attorney, Agent, or Firm*—Oliff & Berridge, PLC

(57) ABSTRACT

In a working apparatus, a recessed portion is formed at an end surface of a pin provided at a boom to house a case of an angle sensor in the recessed portion. A flange is projected from the case along the direction of the axis of an input shaft so as to enclose the input shaft outside the movement range of a lever. By projecting the flange further out than the distance over which the input axis projects out, the protection provided by the flange for the input shaft is enhanced.

12 Claims, 22 Drawing Sheets

WORKING APPARATUS FOR CONSTRUCTION MACHINE

This application is a continuation of PCT International Application No.PCT/JP00/01997 filed Mar. 30, 2000.

INCORPORATION BY REFERENCE

The disclosures of the following priority applications are herein incorporated by reference: Japanese Patent Application No. 11-88797 Japanese Patent Application No. 11-88798 Japanese Patent Application No. 11-113794

BACKGROUND OF THE INVENTION

1. Field of the Invention

The present invention relates to a working apparatus for construction machine and, more specifically, it relates to an working apparatus provided with an angle sensor that measures the relative rotating angles of members rotatably linked to each other such as the boom and the arm of a hydraulic shovel.

2. Related Art

In a construction machine such as a hydraulic shovel, an angle sensor is provided in the working apparatus. In such a working apparatus, the boom and the arm are linked with each other via a pin so as to allow them to rotate relative to each other, and their relative angles are detected by the angle sensor mounted at a side surface of the boom. The angle sensor, which comprises an input shaft, a sensor unit that detects the rotating angle of the input shaft and a case housing the input shaft and the sensor unit. The input shaft is linked or connected to the arm via a lever. When the arm is engaged in rotation relative to the pin, the input shaft at the angle sensor is caused to rotate via the lever which interlocks with the rotation of the arm. The rotating angle of the input shaft is detected by the sensor unit, and the relative angle of the arm is obtained based upon the detected value.

The angle sensor is mounted at the side surface of the boom so as to project out from the side surface, with one end of the lever linked to the input shaft of the angle sensor and the other end of the lever secured to a side surface of the arm. As a result, problems arise during operation in that the angle sensor and the lever projecting out to a side of the boom come into contact with soil and the like and that the angle sensor and the lever tend to interfere with objects in the vicinity.

These problems necessitate a large protective cover to be provided to protect the angle sensor from coming into contact with soil and the like. In addition, when soil or the like comes in contact with the lever, there is a risk of the angle sensor becoming damaged due to the impact to which the input shaft of the angle sensor is subjected via the lever.

SUMMARY OF THE INVENTION

An object of the present invention is to provide a working apparatus for construction machine that prevents the angle sensor provided at the boom or the like from becoming damaged readily by soil and the like.

In order to achieve the object described above, the working apparatus for construction machine according to the present invention comprises a first member, a second member rotatably linked with the first member via a linking member provided as an integrated part thereof and an angle sensor having an input shaft driven to rotate by the first member and a sensor unit that detects the rotating angle of the input shaft, and a recessed portion is formed at an end surface of the linking member along the axial direction thereof to house, at least, an angle sensor case in its entirety within the recessed portion.

Thus, the distance by which the angle sensor projects out from the end surface of the linking member along the axial direction thereof is reduced, thereby reducing the risk of falling soil or the like coming into contact with the angle sensor during operation. In particular, by housing the entire angle sensor inside the recessed portion, soil or the like is not allowed to come into contact with the angle sensor readily, and thus, the protective cover can be omitted.

In addition, a communicating member that links the first member and the input shaft so as to drive the input shaft to rotate by interlocking with the rotation of the first member is provided, (a) a recessed portion is formed at an end surface of the linking member along the axial direction to house the case in the recessed portion and (b) a projected portion projecting out along the axial direction of the input shaft is provided at an end surface of the case so as to enclose the input shaft outside of the movement range of the communicating member. By forming such a projected portion, it is ensured that the input shaft is protected by the projected portion even when soil, rocks and the like come falling down.

Furthermore, by projecting the projected portion of the case out from the end surface thereof along the axial direction further than the distance over which the input shaft projects out, an improvement is achieved in the protective function of the projected portion in protecting the input shaft. By providing an input shaft protective cover, a further improvement is achieved in the degree of protection provided for the input shaft, and also, by securing the input shaft protective cover and the angle sensor to the linking member with a common fastener, the number of required parts can be reduced.

By forming a passage for a wiring harness in the angle sensor case, the wiring harness can be drawn out of the recessed portion from the sensor unit with ease. Alternatively, it is acceptable to provide a seal member that seals the external circumferential surface of the case and the internal circumferential surface of the recessed portion at the external circumferential surface, a groove formed at the external circumferential surface of the case and a passage for the wiring harness formed at the seal member at a position aligned with the position of the groove.

Moreover, by providing a communicating member linking the first member and the input shaft and allowing the link between the first member and the input shaft to become released when an external force equal to or exceeding a specific level is applied to the communicating member, it is possible to ensure that no excessive impact force is applied to the input shaft of the angle sensor, thereby increasing the service life of the angle sensor. For instance, the link may be released by allowing the end of the communicating member slidably inserted in a hole at the input shaft to slip out of the hole or by causing the communicating member to break, when an external force equal to or exceeding the specific level is applied.

DESCRIPTION OF THE PREFERRED EMBODIMENTS

The following is an explanation of the preferred embodiments of the present invention, given in reference to the drawings.

First Embodiment

Figure 1:
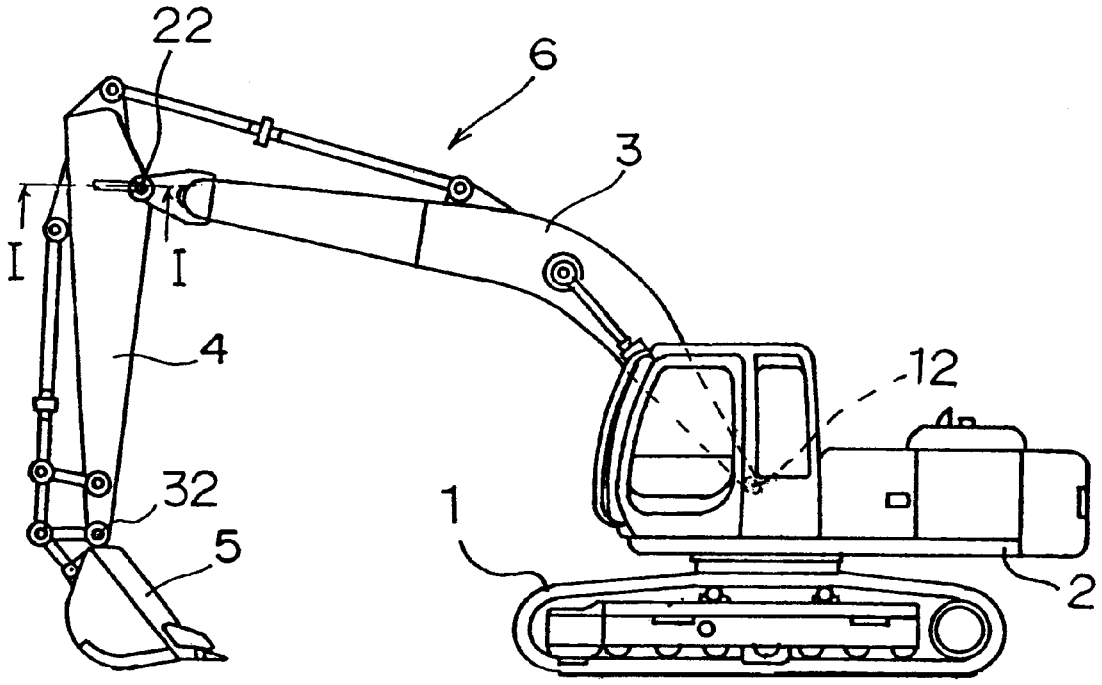
FIG. 1 illustrates a schematic structure of a hydraulic shovel.

In FIG. 1 illustrating a schematic structure of a hydraulic shovel, an upper rotating body 2 is provided at a lower traveling body 1 via a rotating mechanism. A front working apparatus 6 comprising a boom 3, an arm 4 and a bucket 5 is provided at the upper rotating body 2. The boom 3, the arm 4 and the bucket 5 are rotatably linked so as to allow them to rotate relative to the pins 12, 22 and 32.

Figure 2:
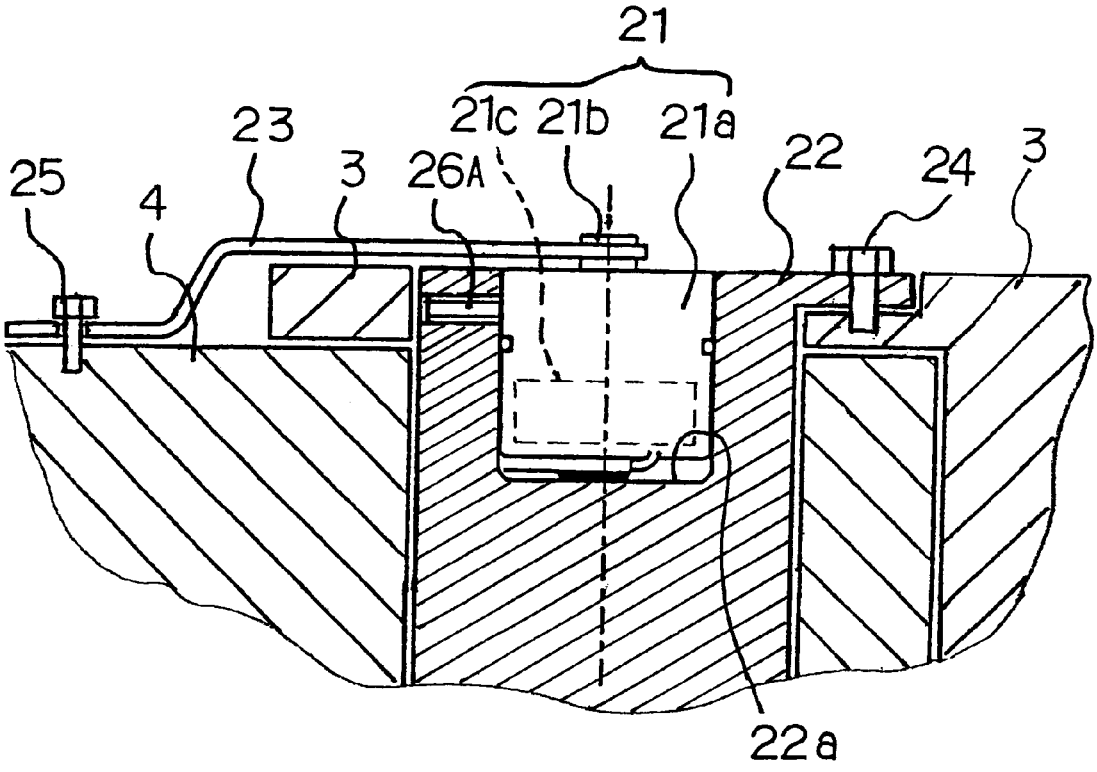
FIG. 2 is a sectional view illustrating the angle sensor in a mounted state in a first embodiment.

FIG. 2 shows an angle sensor in a mounted state at the operating apparatus according to the present invention in a sectional view of the essential portion of the operating apparatus through line I—I in FIG. 1. As explained earlier, the boom 3 and the arm 4 are rotatably connected with each other via the front pin 22. The pin 22 is secured to the boom 3 with a bolt 24 and the arm 4 is rotatably linked to the pin 22. At an end surface of the pin 22, a recessed portion 22*a* having a circular cross-sectional shape is formed coaxially to the center of the axis of the pin 22 to house an angle sensor 21. The angle sensor 21 comprises a case 21*a*, an input shaft 21*b* and a sensor unit 21*c*. The case 21*a* of the angle sensor 21 is housed inside the recessed portion 22*a* so as to allow the input shaft 21*b* to project out from the end surface of the pin 22 and is secured to the pin 22 through a screw 26*a*.

While it is desirable to form the recessed portion 22*a* coaxially to the pin 22 in order to assure a high degree of detection accuracy, the recessed portion 22*a* does not need to be perfectly coaxial with the pin 22 as long as a sufficient degree of accuracy is assured with regard to the coaxial alignment of the input shaft 21*b* of the angle sensor 21 housed in the recessed portion 22*a* and the pin 22.

One end of a lever 23 is linked to the input shaft 21*b* and the other end of the lever 23 is secured to the arm 4 through a bolt 25. Thus, when the angle of the arm 4 changes, i.e., when the arm 4 is rotated by using the pin 22 as the fulcrum, the input shaft 21*b* of the angle sensor 21 is driven to rotate by the lever 23 secured to the arm 4.

Figure 3:
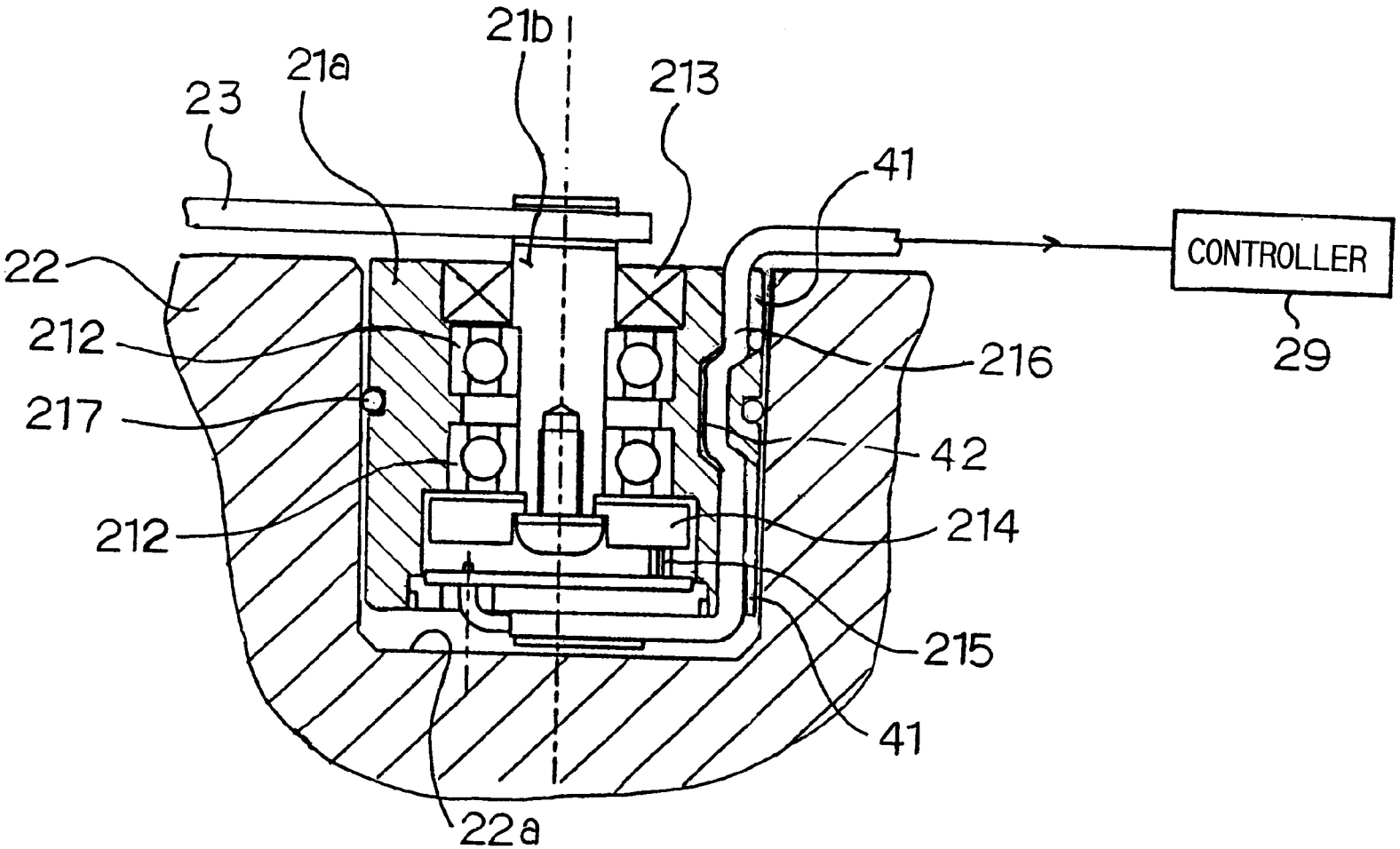
FIG. 3 illustrates the angle sensor 21 in FIG. 2 in further detail.

FIG. 3 is a sectional view illustrating the angle sensor 21 in detail. The input shaft 21*b* is mounted at the case 21*a* via bearings 212. Above the bearings 212 in the figure, a seal 213 which prevents water, oil, mud or the like from entering the case is provided. Reference number 214 is a resistor secured to the input shaft 21*b*, which rotates together with the input shaft 21*b*, and a wiper 215 is provided at a position facing opposite the resistor 214. The sensor unit 21*c* (see FIG. 2) mentioned earlier is constituted of the resistor 214 and the wiper 215. When the input shaft 21*b* is driven to rotate by the lever 23, the resistor 214 engages in rotation, causing the positions of the resistor 214 and the wiper 215 relative to each other to change, which results in a change in the output voltage. This change occurring in the output voltage is communicated to a controller 29 of the hydraulic shovel by a harness 216 connected to the wiper 215, and a change in the angle of the arm 4 relative to the boom 3 is calculated at the controller 29. A seal member 217 such as an O-ring is provided at a side surface of the case 21*a* to prevent water and the like from entering the bottom portion of the recessed portion 22*a*.

Figure 4A:
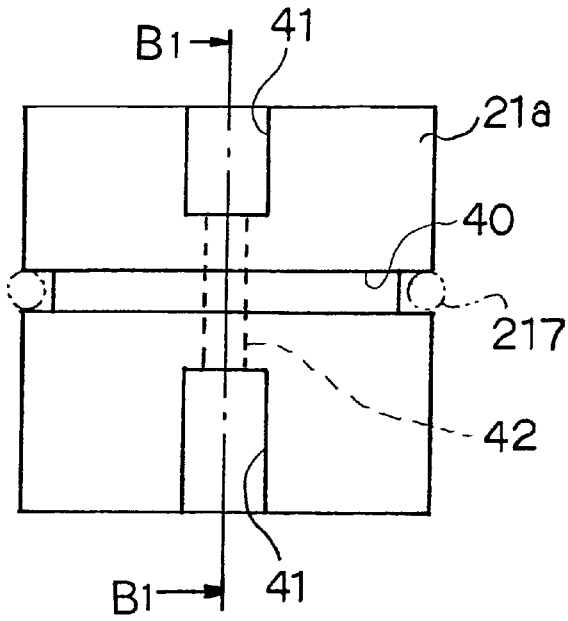
FIG. 4A is a front view of the case 21*a;*
Figure 4B:
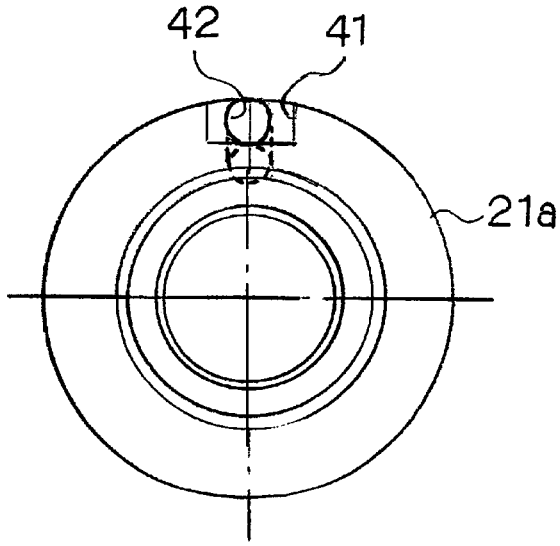
FIG. 4B is a bottom view of the case 21*a* in FIG. 4A.
Figure 4C:
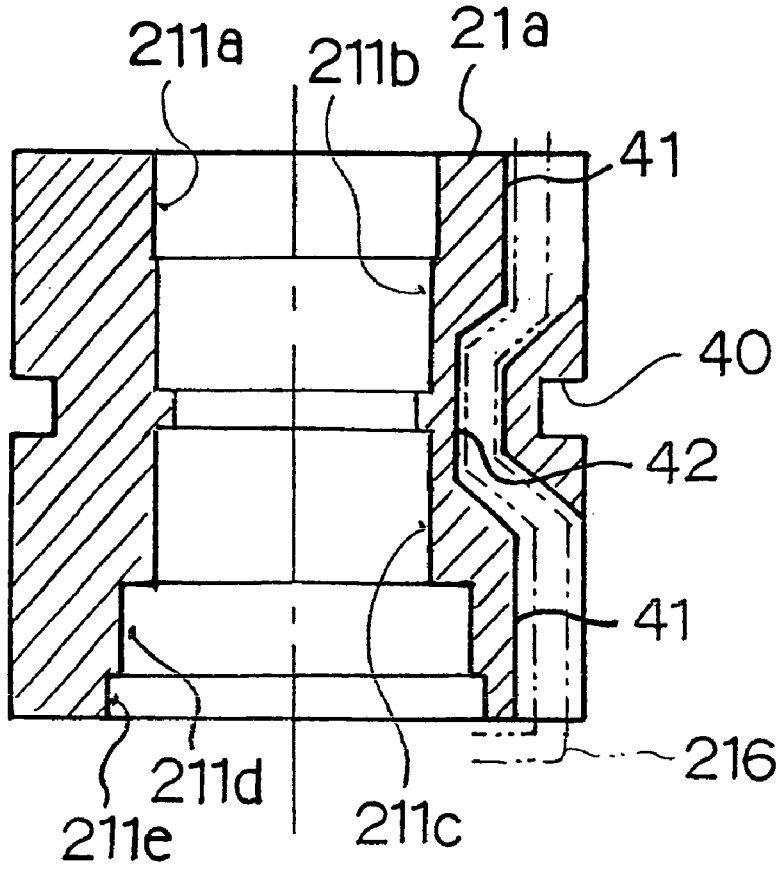
FIG. 4C is a sectional view through B1—B1 in FIG. 4A.

The harness 216 is drawn out of the recessed portion 22*a* via a passage (grooves 41 and a hole 42 to be detailed later) extending from the bottom of the case 21*a* through the case 21*a* and is connected to the controller 29. FIGS. 4A~4C illustrate the case 21*a*, with FIG. 4A presenting a front view of the case 21*a*, FIG. 4B showing the case 21*a* in FIG. 4A viewed from the lower side of the figure and FIG. 4C presenting a sectional view through B1—B1 in FIG. 4B. Inside the case 21*a* formed in a roughly cylindrical shape, a housing portion 211*a* for the seal 213, housing portions 211*b* and 211*c* for the bearings 212, a housing portion 211*d* for the resistor 214 and a housing portion 211*e* for the wiper 215 are individually formed. An O-ring groove 40 is formed as a recessed passage at the external circumference of the case 21*a*. Above and below the O-ring groove 40, the grooves 41 running along the axial direction are formed, and the hole 42 communicating between the upper and lower grooves 41 is formed through the inside of the O-ring groove 40. The harness 216 is threaded from the lower groove 41 to the upper groove 41 via the hole 42, as indicated by the 2-point chain line in FIG. 4C, to be connected to the controller 29 as shown in FIG. 3.

As described above, in this embodiment having the case 21*a* of the angle sensor 21 provided inside the recessed portion 22*a* formed at the end surface of the pin 22 along the axial direction, the distance over which the angle sensor 21 projects out from the boom side surface is reduced, thereby reducing the risk of soil, rocks and the like coming into contact with the angle sensor 21 during operation.

Second Embodiment

Figure 5A:
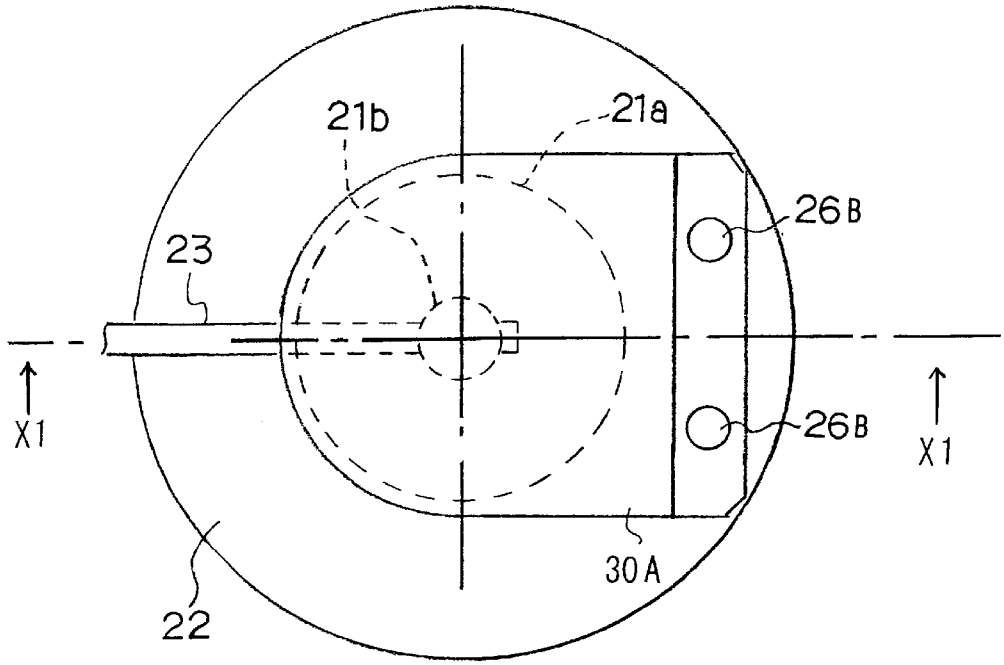
FIG. 5A illustrates a portion of the pin 22 where the angle sensor is provided in a second embodiment, viewed from a side of the boom.
Figure 5B:
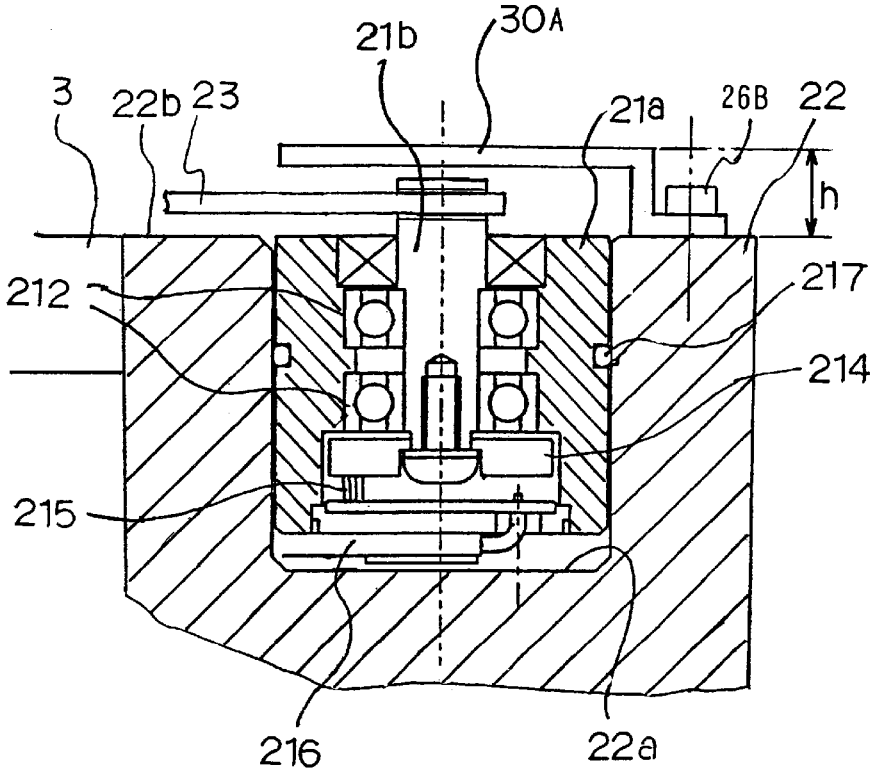
FIG. 5B is a sectional view through X1—X1 in FIG. 5A.

FIGS. 5A and 5B illustrate the second embodiment of the present invention, with FIG. 5A showing the pin 22 over the area where the angle sensor is provided viewed from a side of the boom and FIG. 5B presenting a sectional view through X1—X1 in FIG. 5A. In the embodiments, a protective cover 30A is provided at a side of the input shaft 21*b*. The protective cover 30A, which is mounted at an end surface of the pin 22 with a bolt 26B, achieves a shape which allows it to cover the case 21*a* and the input shaft 21*b* of the angle sensor 21 in their entirety viewed from a side of the boom 3. The angle sensor 21 is protected by the protective cover 30A in this manner, so that soil and the like are prevented from coming into contact with the angle sensor 21 from a side of the boom 3.

Since the entire case 21*a* is housed inside the recessed portion 22*a* and the input shaft 21*b* alone is projected out to the side (the upper side in the figure) from the pin end surface 22*b* in this embodiment, too, the distance h over which the protective cover 30A projects out can be reduced compared to the prior art.

Third Embodiment

Figure 6:
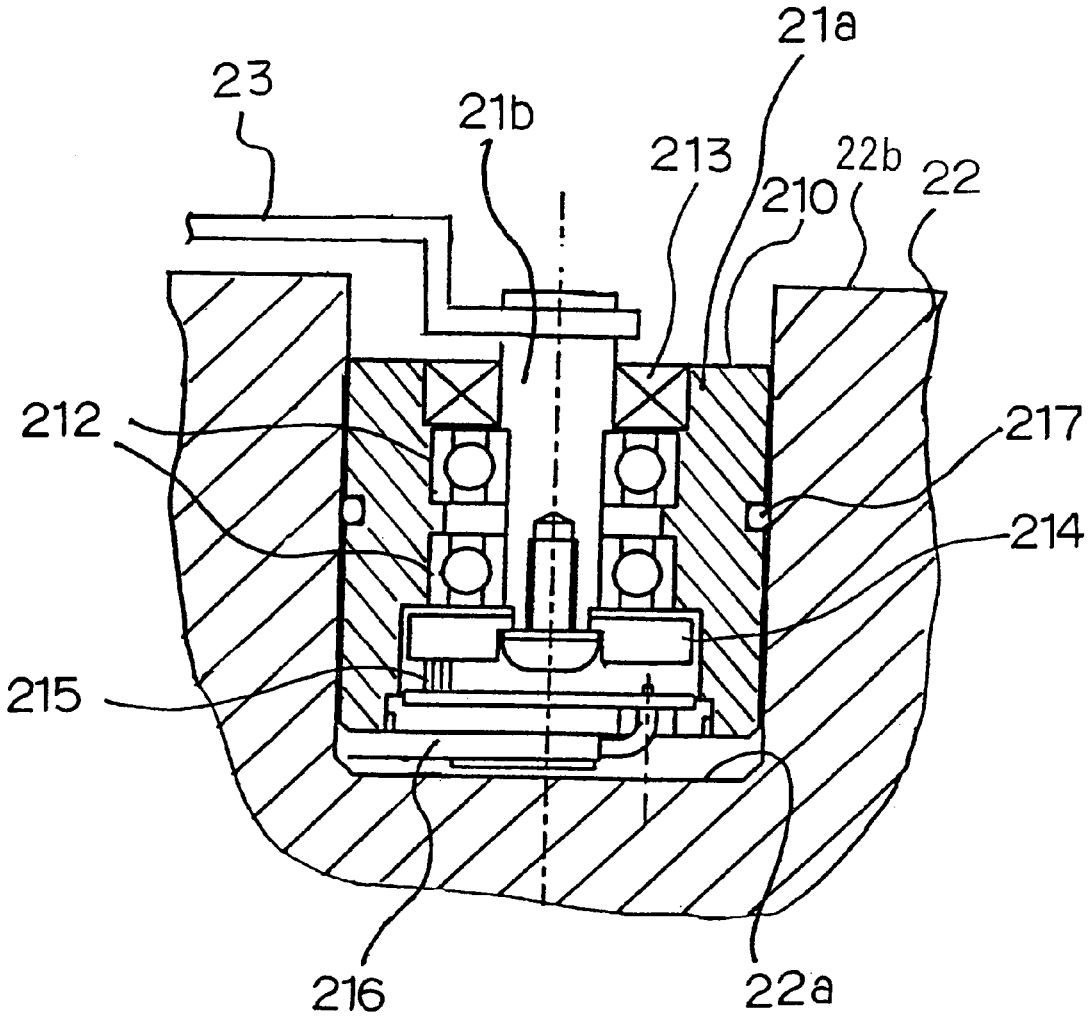
FIG. 6 illustrates a third embodiment.

In FIG. 6, illustrating the third embodiment of the present invention, the entire angle sensor 21 including the input shaft 21*b* is housed inside the recessed portion 22*a* of the pin 22. By housing the entire angle sensor 21 inside the recessed portion 22*a* in this manner, only the lever 23 is projected out of a side of the boom, thereby making it possible to dispense with a protective cover for protecting the angle sensor 21.

Fourth Embodiment

Figure 7:
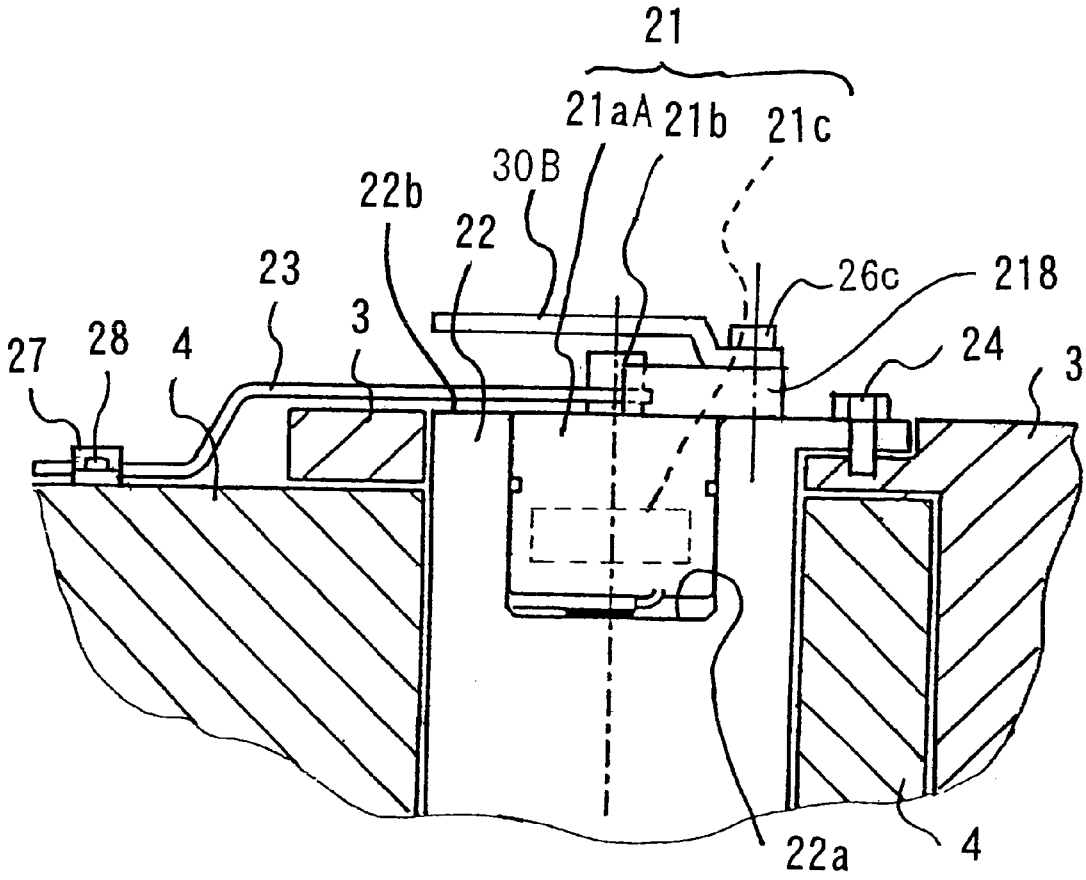
FIG. 7 presents a sectional view of the pin 22 provided in a fourth embodiment.
Figure 8:
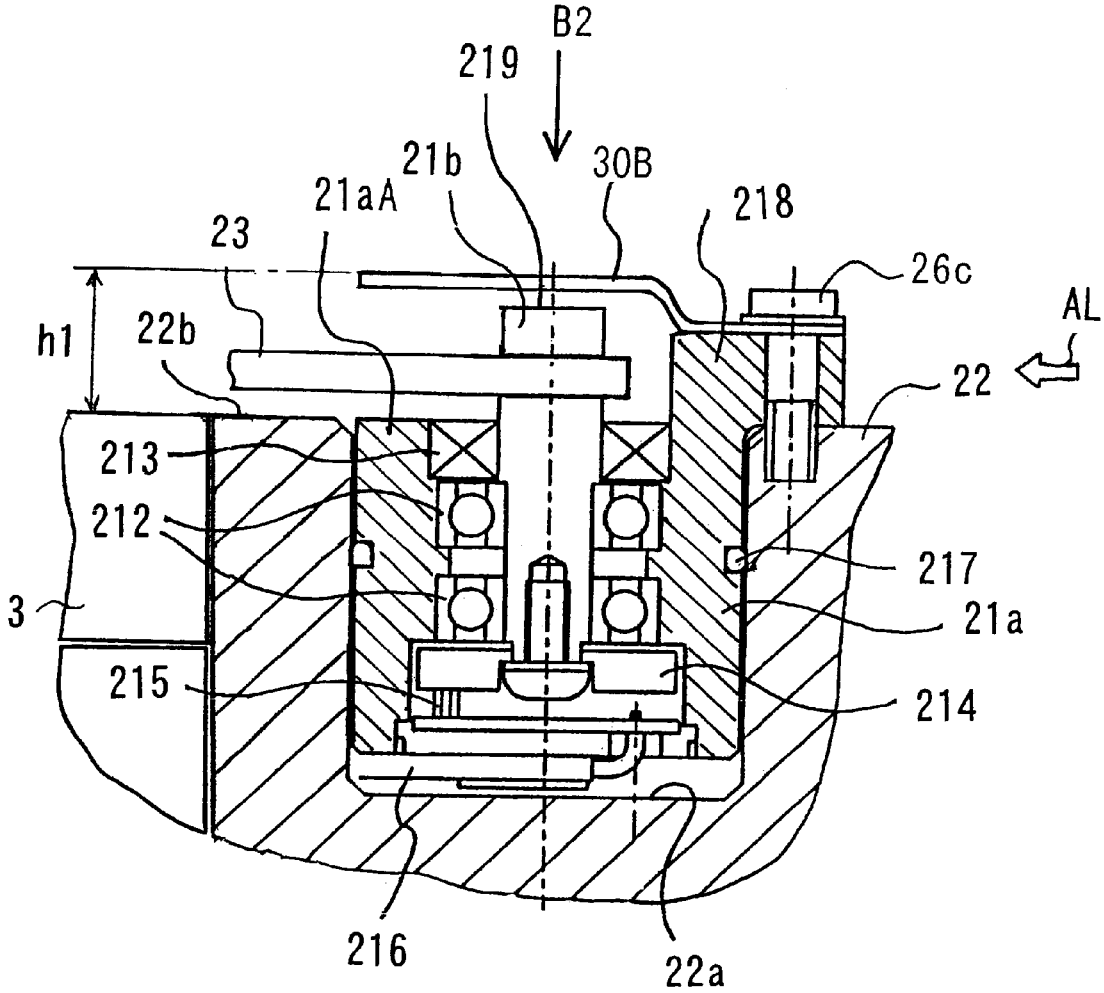
FIG. 8 illustrates the angle sensor 21 in FIG. 7 in further detail.

In FIGS. 7 and 8 illustrating the fourth embodiment of the present invention, sectional views of the pin 22 are presented as in FIG. 2. FIG. 8 presents a more detailed sectional view which includes the angle sensor 21. A case 21*a*A of the angle sensor 21 is housed inside the recessed portion 22*a* as in FIG. 2, and is secured to the in 22 with a screw (not shown) (the screw 26A in FIG. 2).

A flange 218 projects out at an end surface of the case 21*a*A, and by securing the flange 218 to the end surface 22*b* of the pin 22 with a bolt 26C, the angle sensor 21 is mounted at the pin 22. A protective cover 30B, which protects the input shaft 21*b* from impact from soil and the like, is mounted as an integrated part of the angle sensor 21 at the pin 22 with the bolt 26C.

One end of the lever 23 is linked to the input shaft 21*b* projecting out from the end surface 22*b* of the pin 22, and the other end of the lever 23 is secured to the arm 4 with a bracket 27. Reference number 28 indicates a bolt used to mount the bracket 27 at the arm 4. An upper end surface 219 of the input shaft 21*b* in the figure projects out to the side (the upper side in the figure) from the end surface 22*b* of the pin 22.

Figure 9:
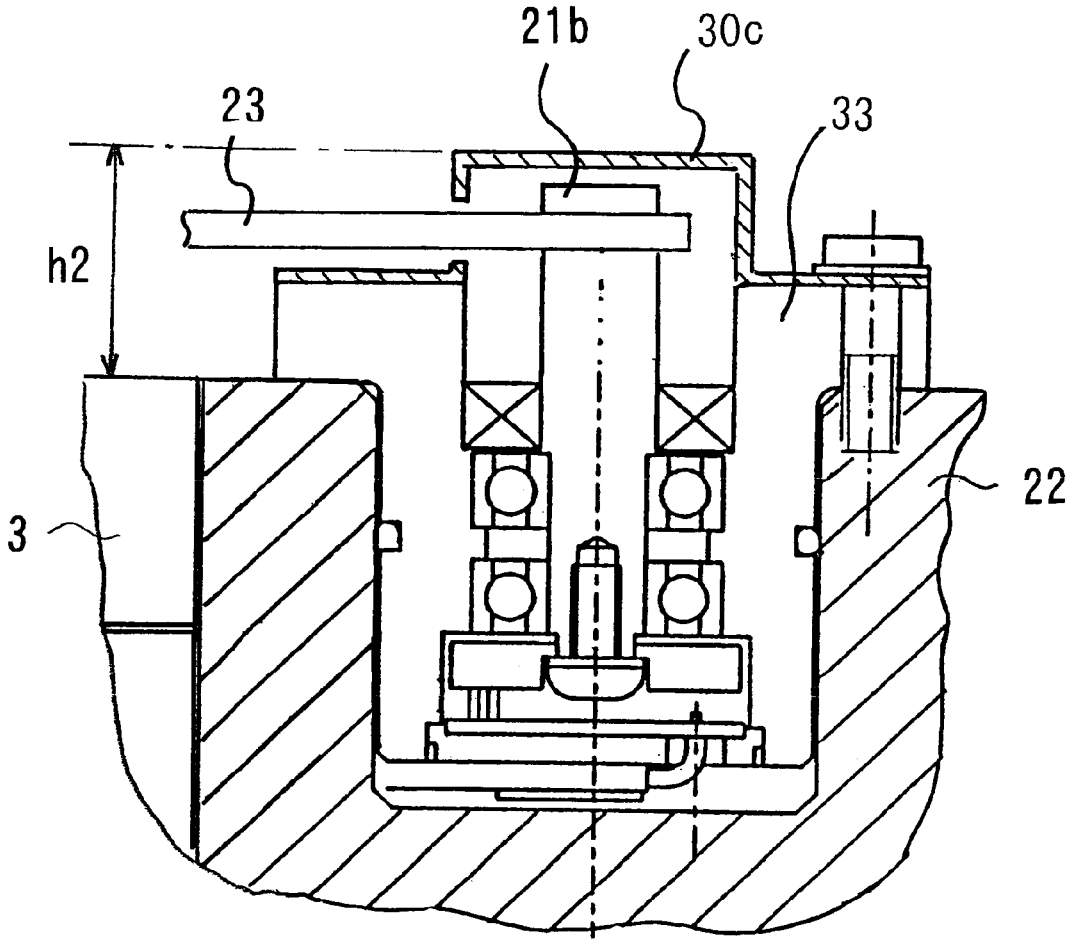
FIG. 9 illustrates a structure achieved by providing a flange 33 over the entire circumference of the input shaft 21*b;*

As shown in FIG. 7, one end of the lever 23 is secured to the arm 4 with a bracket 27, and thus, the lever 23 causes the input shaft 21*b* of the angle sensor 21 to rotate when the arm 4 is rotated. The flange 218 is formed in an arc shape so as to remain outside of the movement range of the lever 23. By forming the flange 218 in an arc shape in this manner, the distance over which the protective cover 30B projects out from the side surface of the boom 3 (h1 in FIG. 8) can be minimized. Namely, if the flange 218 is formed in a toroidal shape as a flange 33 in FIG. 9 is, the input shaft 21*b* must be made to project out further than the flange 33 with the lever 23 provided further to the side (further toward the upper side in the figure) relative to the flange 33. As a result, there is a problem in that the distance h 2 (>h1) over which the protective cover 30C projects out from the side surface of the boom 3 becomes large. However, in the embodiment described above, the projecting distance can be minimized compared to that in the structure shown in FIG. 9, to prevent falling objects such as soil and rocks from coming into contact with the angle sensor 21 readily.

Figure 10:
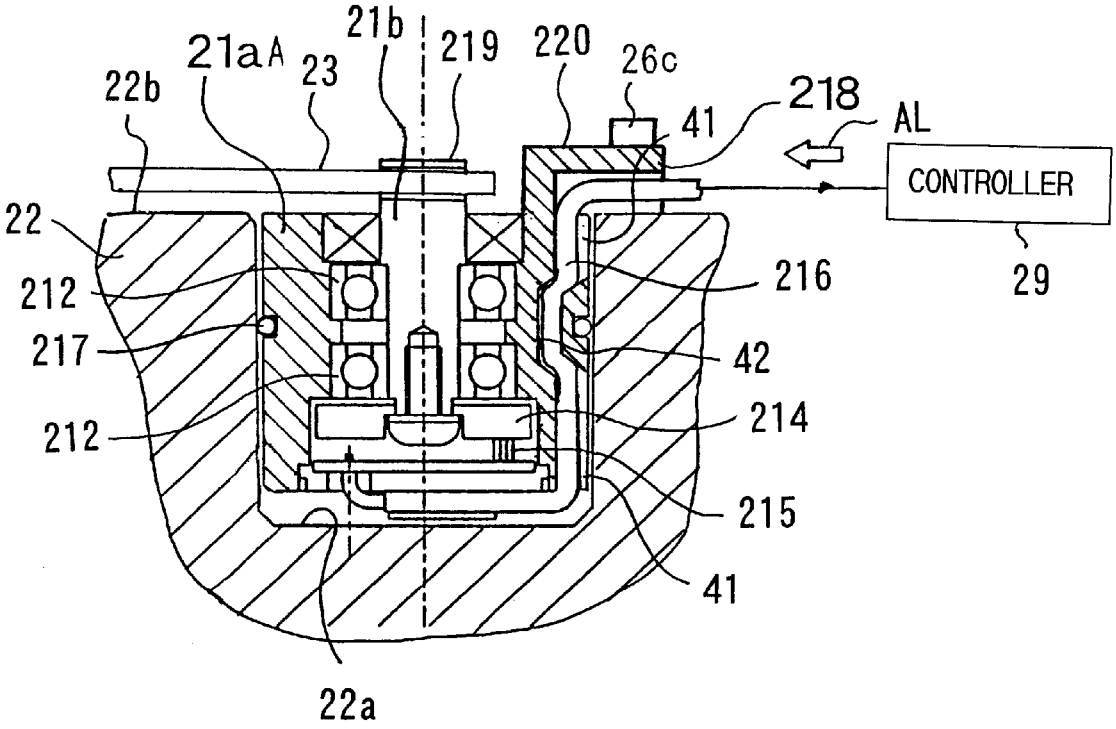
FIG. 10 illustrates how the harness 216 is mounted.

In addition, since the flange 218 projects out so as to enclose the input shaft 21*b*, the input shaft 21*b* is protected from falling soil and rocks along the pin end surface 22*b* (along the direction indicated by the arrow AL in FIG. 8) without having to provide the protective cover 30B. Thus, by setting the end surface 219 of the input shaft 21*b* further toward the pin relative to an end a surface 220 of the flange 218 as illustrated in FIG. 10, it becomes possible to dispense with the protective cover 30B in FIG. 8. The boom pin (the pin 12 in FIG. 1) which is not likely to be impacted by soil from the direction of the pin end surface, in particular, does not require the protective cover 30B in this structure.

Figure 11A:
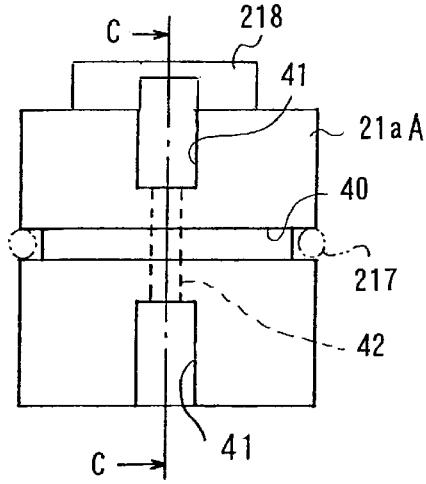
FIG. 11A is a front view of the case 21*a*A.
Figure 11B:
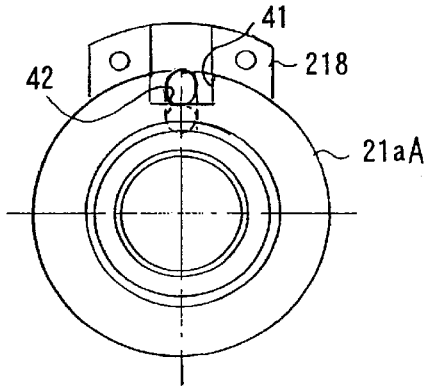
FIG. 11B is a bottom view of the case 21*a*A in FIG. 11A.
Figure 11C:
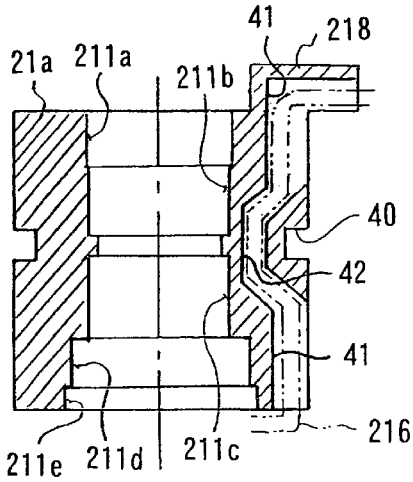
FIG. 11C is a sectional view through C—C in FIG. 11A.

Next, a specific method for mounting the harness 216 is explained. As illustrated in FIG. 10, the harness 216 is drawn out of the recessed portion 22*a* via a passage (grooves 41 and a hole 42 to be detailed later) extending from the bottom portion of the case 21*a*A through the case 21*a*A and is connected to the controller 29. FIGS. 11A, 11B and 11C show the case 21*a*A, with FIG. 11A presenting a front view of the case 21*a*A, FIG. 11B showing the case 21*a*A in FIG. 11A viewed from the lower side of the figure and FIG. 11C presenting a sectional view through C—C in FIG. 11A. A flange 218 formed as shown in FIGS. 11A~11C is provided at the upper end of the case, and the case 21*a*A is identical to the case 21*a* shown in FIGS. 4A~4C except for the flange 218.

At positions above and below the O-ring groove 40, the grooves 41 extending along the axial direction are formed, and the hole 42 communicating between the upper and lower grooves 41 is formed through the inside of the O-ring groove 40. It is to be noted that the upper groove 41 in the figures is formed at the lower surface of the flange 218 as well as at a side surface of the case 21*a*A. The portion of the groove 41 formed at the lower surface of the flange 218 extends along the direction of the radius of the case 21*a*A. The harness 216 is provided to extend from the lower groove 41 to the upper groove 41 via the hole 42 as indicated by the 2-point chain line and is drawn out of a flange 218 to be connected to the controller 29, as illustrated in FIG. 10.

Figure 12A:
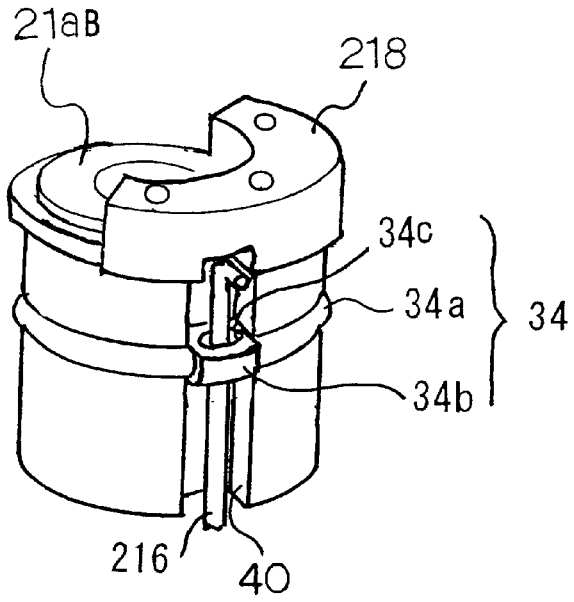
FIG. 12A presents a perspective of the case 21*a*B which is a variation of the case 21*a*A.
Figure 12B:
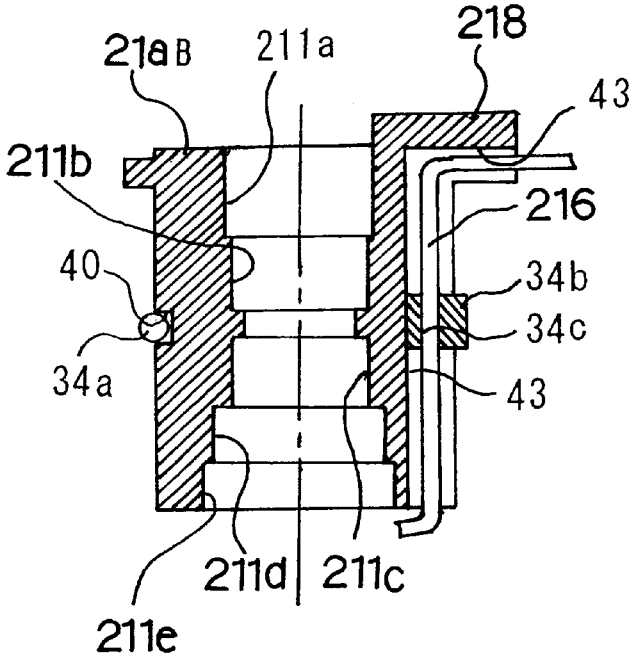
FIG. 12B is a sectional view illustrating the case 21*a*B in detail.

A case 21*a*B shown in FIGS. 12A and 12B is a variation of the case 21*a*A, with FIG. 12A presenting a perspective of the case 21*a*B and FIG. 12B presenting a sectional view illustrating the case 21*a*B in detail. Inside the case 21*a*B, which is formed in a roughly cylindrical shape as is the case 21*a*A, a housing portion 211*a* for an oil seal 213, housing portions 211*b* and 211*c* for the bearings 212, a housing portion 211*d* for the resistor 214 and a housing portion 211*e* for the wiper 215 are individually formed. As illustrated in FIG. 12A, a seal member 34 is provided at the case 21*a*B.

Figure 13A:
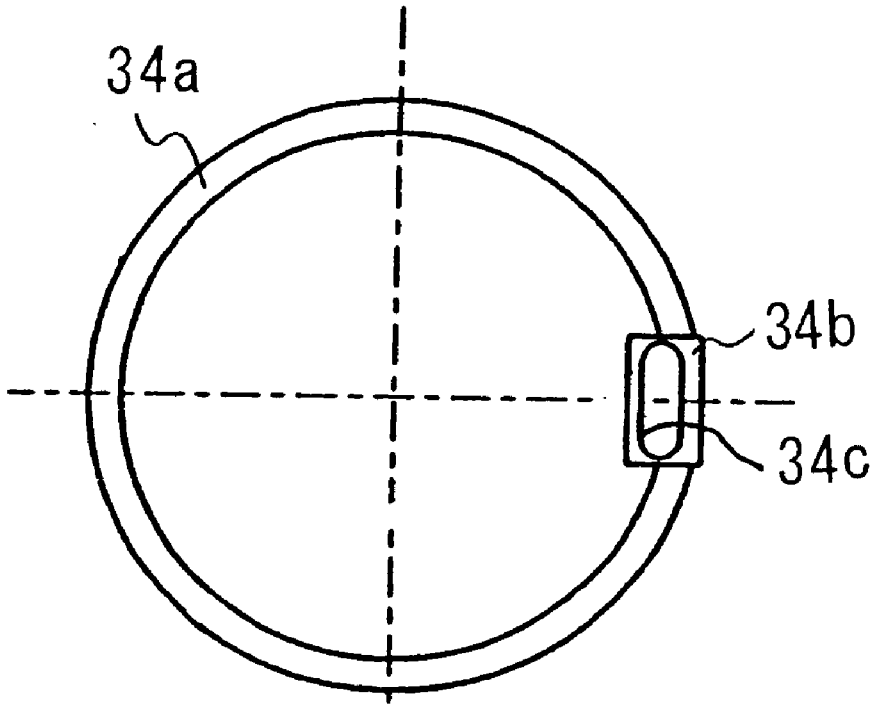
FIG. 13A is a plan view of the seal member 34.
Figure 13B:
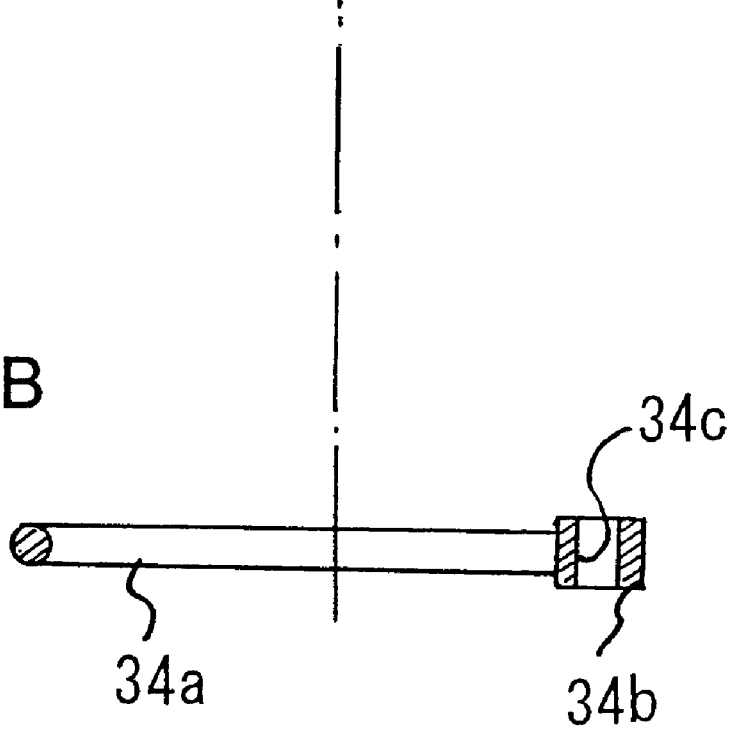
FIG. 13B is a sectional view of FIG. 13A.

FIGS. 13A and 13B respectively present a plan view and a sectional view of the seal member 34. The seal member comprises an O-ring portion 34*a* and the cable passing portion 34*b* that constitute an integrated component. A hole 34*c* through which a cable 216 passes is formed at the cable passing portion 34*b*.

At the external circumferential surface of the case 21*a*B shown in FIGS. 12A and 12B, an O-ring groove 40, in which the seal member 34 is placed, and the groove 43 extending along the axial direction in which the cable 216 is placed are formed. When mounting the seal member 34 in the groove 40, the cable passing portion 34*b* of the seal member 34 is set at the groove 43. The groove 43 is formed along the axial direction at the side surface of the case 21*a*B and along the direction of the radius (the horizontal direction in FIG. 12B) of the case 21*a*B at the lower surface of the flange 218. The cable 216 is provided along the groove 43 from the bottom portion of the case 21*a*B, passes through the hole 34*c* at the cable passing portion 34*b* and is drawn out upward. The gap between the cable 216 and the hole 34*c* is sealed by using a molding material or the like.

Fifth Embodiment

Figure 14:
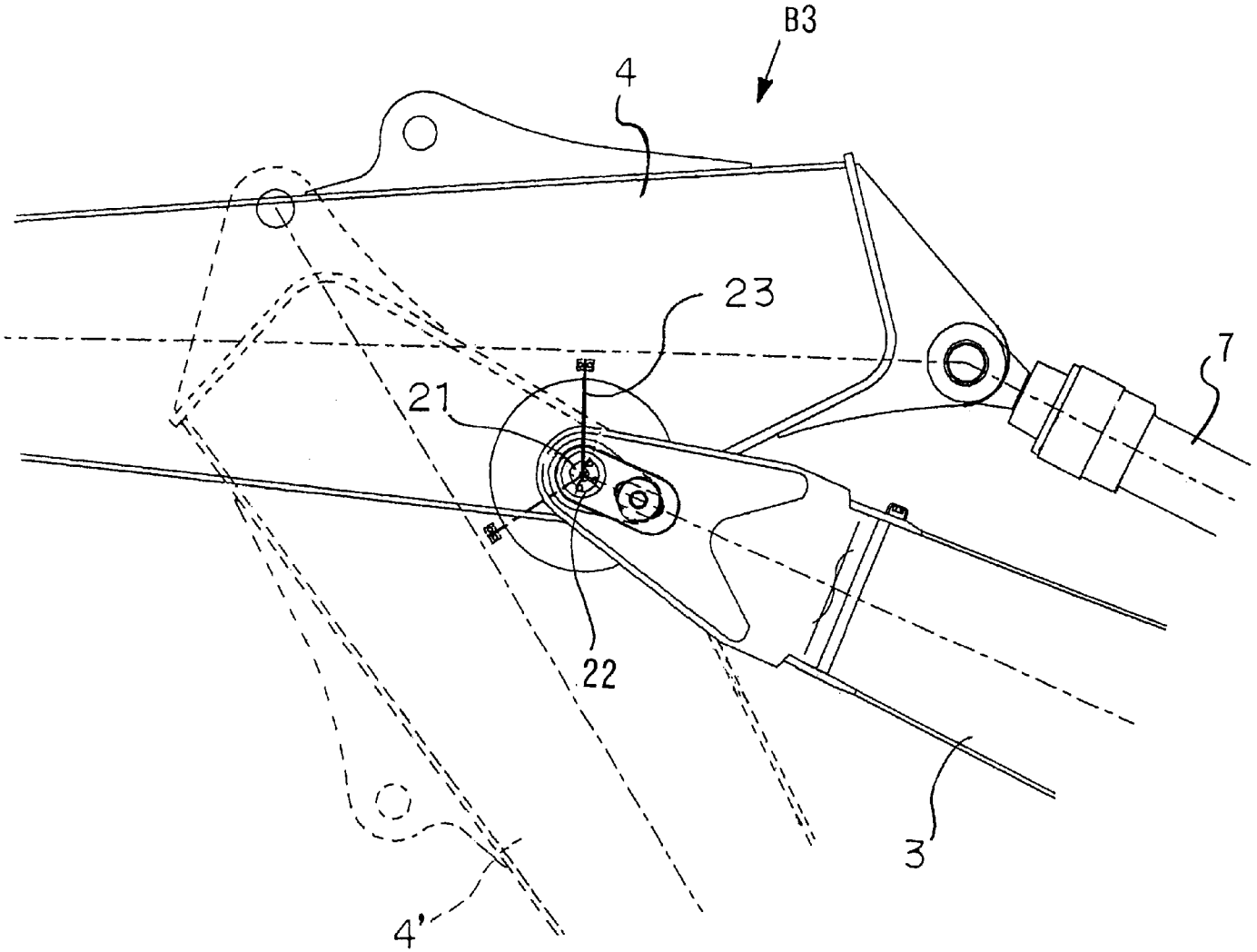
FIG. 14 is an enlarged view of the area in the vicinity of the pin 22 in the front operating apparatus 6 in FIG. 1.
Figure 15:
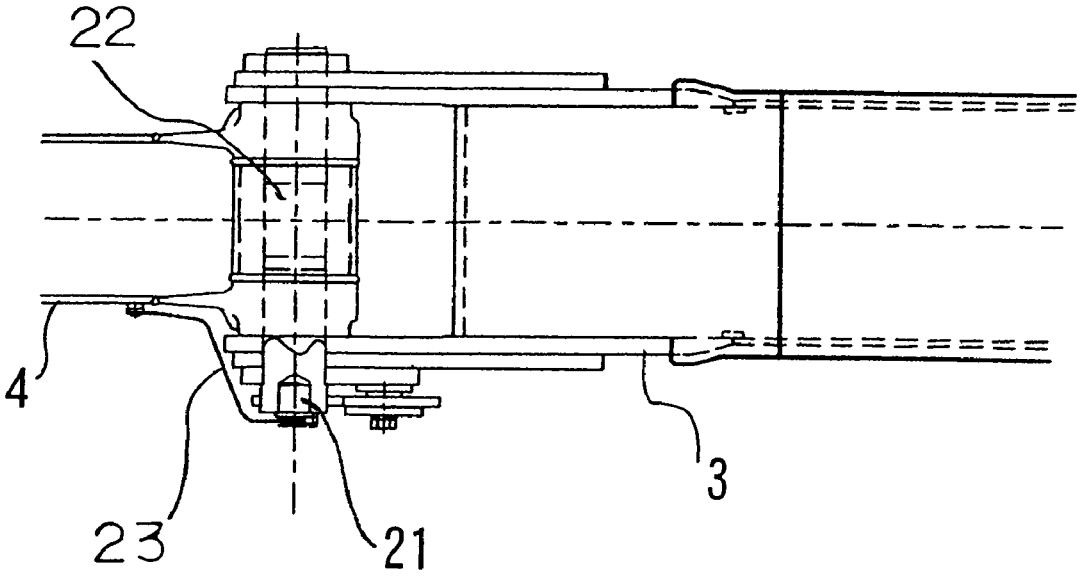
FIG. 15 illustrates the linking area in FIG. 14, viewed from direction B3.
Figure 16:
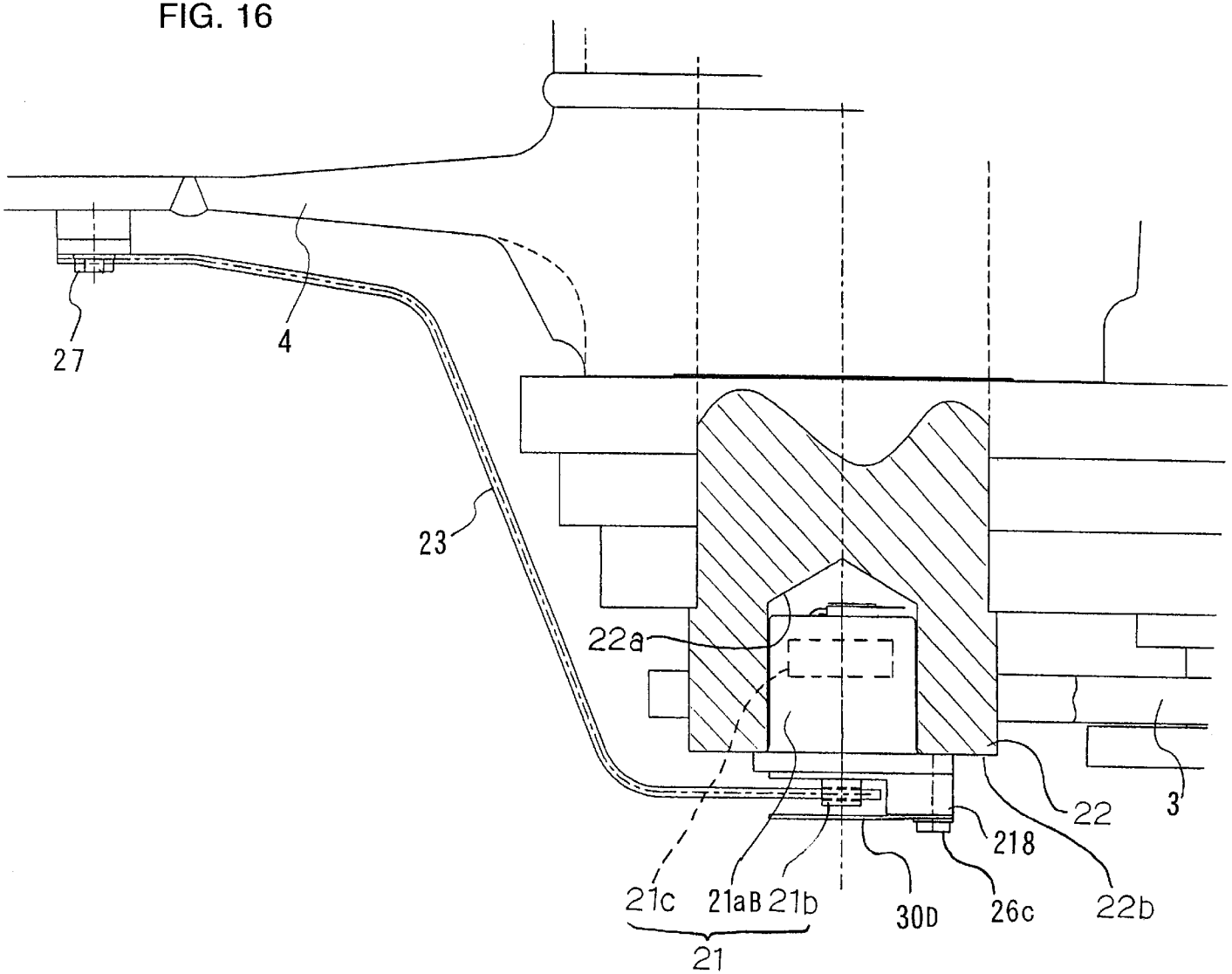
FIG. 16 illustrates the angle sensor 21 in FIG. 15 in detail.

Next, the fifth embodiment is explained in reference to FIGS. 14~20C. The fifth embodiment is characterized by the connection between the lever 23 and the input shaft 21*b*. FIG. 14 is an enlarged view of the vicinity of the pin 22 at the front working apparatus 6 in FIG. 1 and FIG. 15 shows the linking portion in FIG. 14 viewed from direction B3. The pin 22 is secured to the boom 3, and the arm 4, which is rotatably linked to the pin 22, is caused to rotate as a hydraulic cylinder 7 expands and contracts. That change in the angle of arm 4 relative to the boom 3 is detected by the angle sensor 21 provided at the pin 22. In FIG. 16, which shows the angle sensor 21 in FIG. 15 in detail, a recessed portion 22*a* having a substantially circular cross sectional shape is formed at an end surface of the pin 22 coaxially to the center of the axis of the pin 22 and the angle sensor 21 is provided in the recessed portion 22*a* as described earlier.

The angle sensor 21 in FIG. 16 is provided with the case 21*a*B in FIGS. 12A and 12B. The case 21*a*B is mounted at the pin 22 with the bolt 26C. Reference number 30D indicates a protective cover which protects the input shaft 21*b* from the impact of soil and the like, and the protective cover 30D is mounted at the pin 22 as an integrated part of the angle sensor 21 with the bolt 26C. As explained earlier, while it is desirable to form the recessed portion 22*a* coaxially to the pin 22, in order to achieve a higher degree of detection accuracy, the recessed portion 22*a* does not need to achieve perfect coaxial alignment with the pin 22 as long as the input shaft 21*b* of the angle sensor 21 provided inside the recessed portion 22*a* and the pin 22 achieve coaxial alignment within a specific range, i.e., as long as a sufficient degree of accuracy is assured.

One end of the lever 23 is linked to the input shaft 21*b* projecting out from the end surface 22*b* of the pin 22, and the other end of the lever 23 is secured to the arm 4 with the bracket 27. It is to be noted that the link between the input shaft 21*b* and the lever 23 is to be detailed later. The lever 23, which is constituted of an elastic material such as a piano wire (the following explanation is given on the assumption that the lever 23 is constituted of a piano wire) is formed to extend along a path close to the side surfaces of the boom 3 and the arm 4, as shown in FIG. 16. By providing the lever 23 close to the side surfaces of the boom 3 and the arm 4 in this manner, the risk of impact from soil, rocks and the like occurring during operation can be reduced. When the angle of the arm 4 is changed, i.e., when the arm 4 is rotated by using the pin 22 as the fulcrum, the input shaft 21*b* of the angle sensor 21 is driven to rotate by the lever 23 secured to the arm 4.

Figure 17:
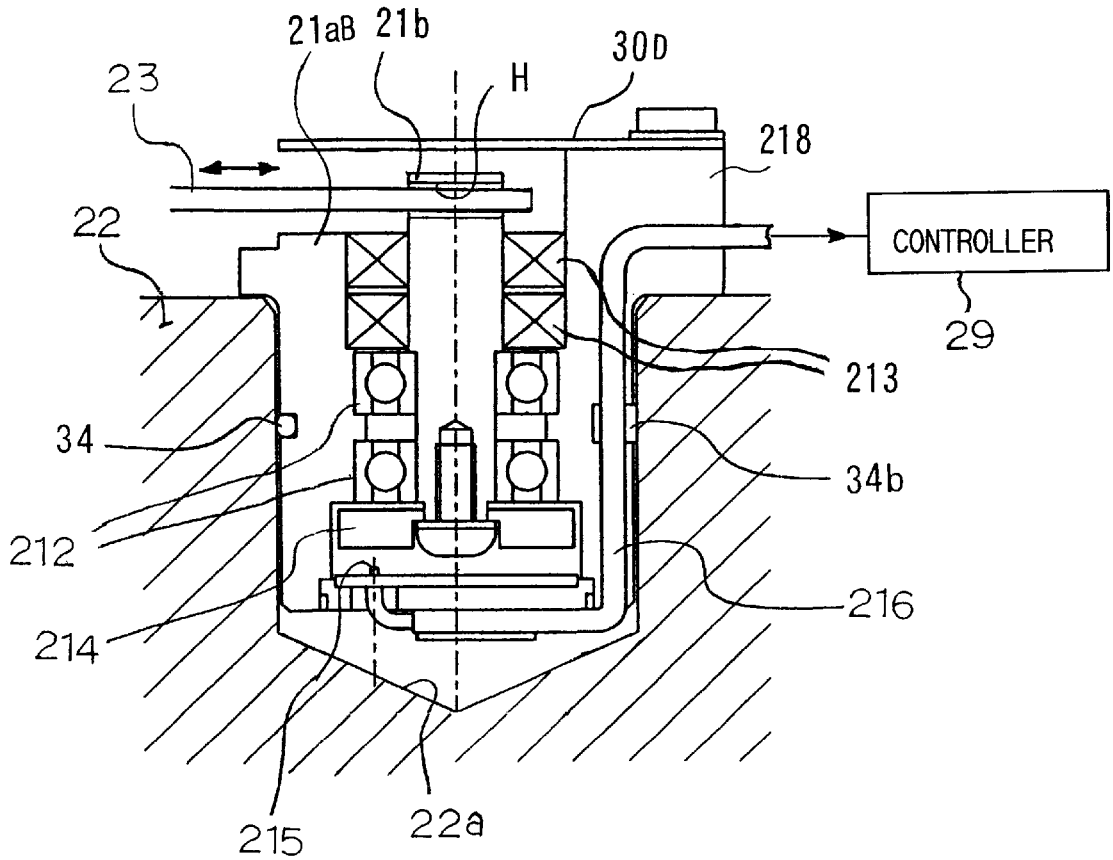
FIG. 17 is a sectional view illustrating the angle sensor 21 in FIG. 16 in detail.

FIG. 17 is a sectional view illustrating the angle sensor 21 in detail. The input shaft 21*b* is mounted at the case 21*a*B via bearings 212. A hole H substantially perpendicular to the axial direction is formed at the input shaft 21*b*, and by inserting an end of the lever 23 at the hole H the input shaft 21*b* and the lever 23 are linked. The diameter of the hole H is larger than the wire diameter of the lever 23 to allow the lever 23 to slide relative to the hole H along the horizontal direction in the figure.

Above the bearings 212 in the figure, oil seals 213 for preventing entry of water, oil, mud and the like into the case are provided. Reference number 214 indicates a resistor secured to the input shaft and caused to rotate together with the input shaft, and a wiper 215 is provided at a position facing opposite the resistor 214. The sensor unit 21*c* mentioned earlier is constituted of the resistor 214 and the wiper 215. When the input shaft 21*b* is driven to rotate by the lever 23, the resistor 214 also rotates, which changes the positions of the resistor 214 and the wiper 215 relative to each other to change the output voltage from the resistor 214. This change in the output voltage is communicated to the controller 29 of the hydraulic shovel through a cable 216 connected to the wiper 215, and the change in the angle of the arm 4 relative to the boom 3 is calculated at the controller 29.

The seal member 34 mentioned earlier (see FIGS. 13A and 13B) is provided at the side surface of the case 21*a*B to prevent entry of water and the like into the bottom portion of the recessed portion 22*a*. The cable 216 passes through the case 21*a*B and the seal member 34, is drawn out of the sensor through the flange 218 and is connected to the controller 29.

Figure 18A:
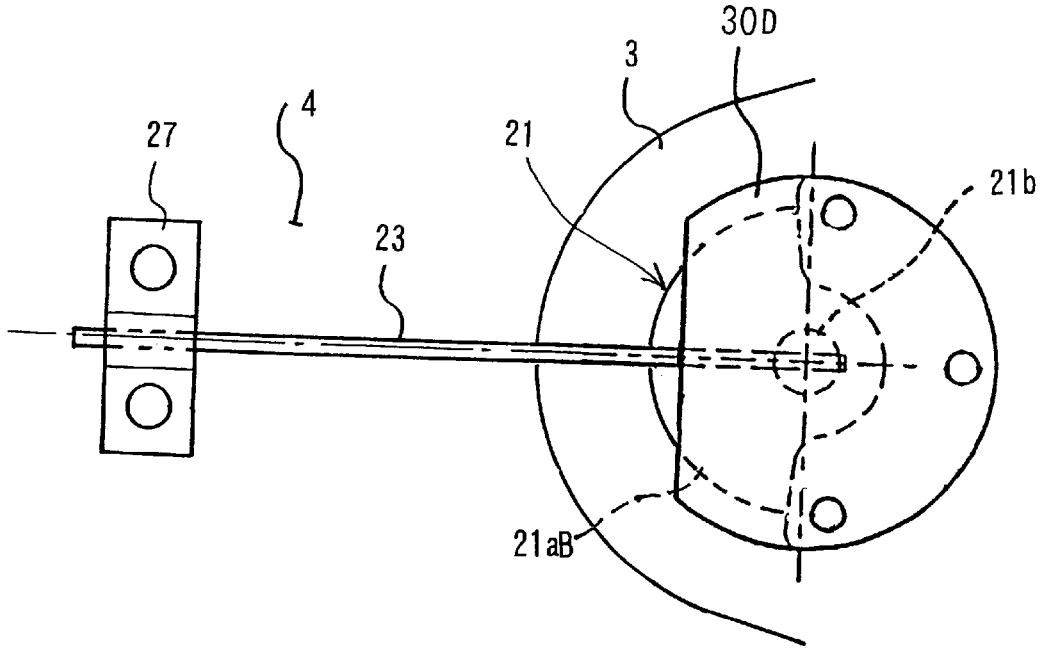
FIG. 18A shows the angle sensor 21 and the lever 23 viewed from a side of the boom.
Figure 18B:
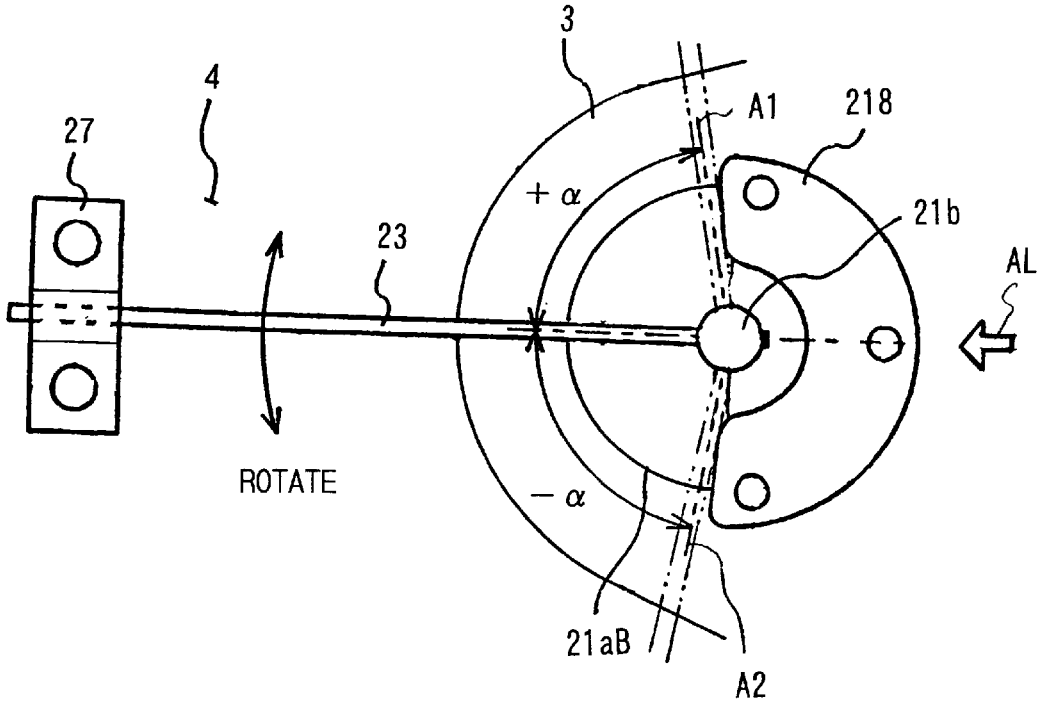
FIG. 18B illustrates the angle sensor 21 and the lever 23, with the protective cover 30C in FIG. 18A removed.

FIGS. 18A and 18B show the angle sensor 21 and the lever 23 viewed from a side of the boom. FIG. 18B shows them in a state in which the protective cover 30D is removed. The left end of the lever 23 is secured to the arm 4 with the bracket 27, and when the arm 4 is rotated and its angle changes, the lever 23 causes the input shaft 21*b* of the angle sensor 21 to rotate. The rotating range of the arm 4 over which the arm 4 rotates relative to the boom 3 is limited to a specific angle range by the stroke of the hydraulic cylinder 7 shown in FIG. 14 and, in the example presented in FIG. 18B, the lever 23 interlocking with the arm 4 rotates over the range A1~A2 ($\pm\alpha°$) indicated by the 2-point chain line. It is to be noted that the lever 23 is set at A1 when the state of the arm 4 is as indicated by the solid line in FIG. 14, whereas the lever 23 is set at A2 when the arm 4 has rotated as indicated by the dotted line 4.

As described above, the lever 23 rotates within the range A1~A2, and accordingly, the flange 218 is formed in an arc shape to ensure that the lever 23 and the flange 218 do not interfere with each other, as illustrated in FIG. 18B. By projecting out the arc-shaped flange 218 so as to enclose the input shaft 21*b* in this manner, the input shaft 21*b* is protected from falling soil, rocks and the like along the end surface of the pin 22 (along the direction indicated by the arrow AL in FIG. 18B) even without the protective cover 30C. It is not necessary to provide the protective cover 30D especially for the boom pin (pin 12 in FIG. 1) which is less likely to impact with soil from the direction of the end surface of the pin 22.

The embodiment having the lever 23 constituted of an elastic material such as piano wire and slidably inserted at the hole H of the input shaft 21*b* achieves the following advantages. Namely, the lever 23 undergoes elastic deformation if it is struck by soil or the like to slip out of the hole H, thereby releasing the link between the lever 23 and the input shaft 21*b*. As a result, the input shaft 21*b* can not be subjected to an excessive degree of impact.

Figure 19A:
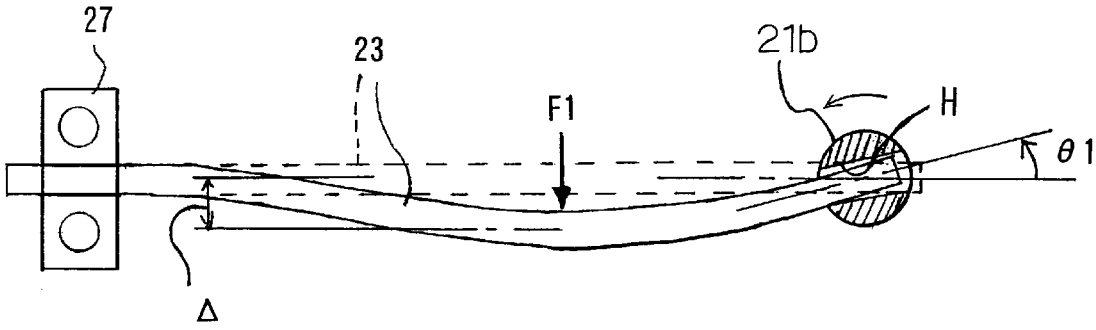
FIG. 19A illustrates the lever 23 in a state in which a load F1 is applied.
Figure 19B:
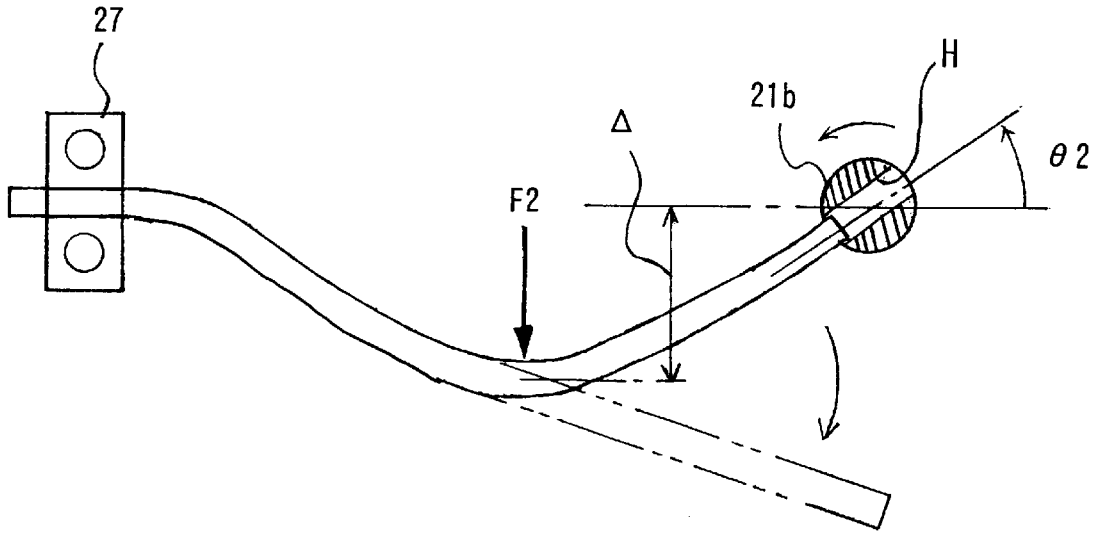
FIG. 19B illustrates the lever 23 in a state in which a load F2 is applied.

FIGS. 19A and 19B conceptually illustrate the lever 23 to which loads F1 and F2 along the side surface of the boom 3 applied when the lever 23 comes into contact with soil. The load F1 in FIG. 19A is relatively small, whereas FIG. 19B presents an example in which a larger load F2 (F2>F1) is applied to the lever 23. In FIG. 19A, indicated by the dotted line is the lever 23 in a normal state in which no impact load is applied to it. It is to be noted that the explanation is given on the assumption that the lever 23 is constituted of a linear piano wire.

In the example presented in FIG. 19A, the lever 23 becomes deformed to bend downward due to the load F1 (deformation quantity Δ), and this deformation causes the input shaft 21*b* to rotate counterclockwise by an angle θ1. In addition, the deformation of the lever 23 reduces the length of the lever 23 over which it is inserted at the hole H. In the example presented in FIG. 19B, with the larger load F2 applied to the lever 23, the deformation quantity Δ of the lever 23 increases, causing the input shaft 21*b* to rotate counterclockwise by a larger angle θ2 (>θ1) and, as a result, the length of the lever 23 inserted at the hole H is greatly reduced. If a load even larger than F2 is applied to the lever 23, i.e., if (impact load)>F2, the deformation quantity Δ of the lever 23 and the rotating angle of the input shaft 21*b* further increase, to result in the lever 23 slipping out of the hole H as indicated by the two-point chain line, thereby releasing the link between the lever 23 and the input shaft 21*b*.

If a strong lever constituted of a steel plate, for instance, as in the prior art is secured to the input shaft 21*b*, the link between the input shaft 21*b* and the lever is not released even when an excessive load is applied to the lever, resulting in a great impact force being applied to the input shaft 21*b*. This presents a risk of the bearings 212 supporting the input shaft 21*b* and the sensor unit 21*c* becoming damaged when the lever comes in contact with rocks and the like. However, in this embodiment, in which the link between the lever 23 and the input shaft 21*b* is released if an excessive load is applied to the lever 23 as described above, no excessively large impact force is applied to the input shaft 21*b* and an increase in the service life of the angle sensor 21 is achieved.

The level of the load required for the lever 23 to slip out of the hole H at the input shaft 21*b* is determined in conformance to the elastic coefficient of the piano wire constituting the lever 23, the diameter of the piano wire, the length of the lever 23 over which it is inserted at the hole H and the like, and should be set as appropriate in correspondence to the level of the load tolerated by the angle sensor 21. For instance, by reducing the diameter of the piano wire to allow for easy deformation or by reducing the length over which the lever is inserted at the hole, the lever 23 is allowed to slip out of the hole H even at a small load, to reduce the degree to which the angle sensor 21 is affected.

Figure 20A:
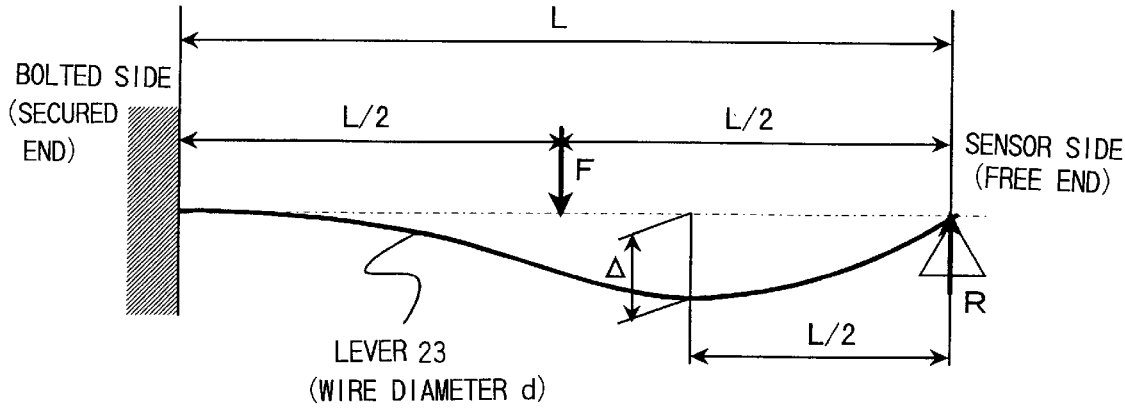
FIG. 20A illustrates the lever 23 in a state in which an external force F is applied.

An example of the method for setting the dimensions of the lever 23 is now explained in reference to FIGS. 20A~20D. FIG. 20A illustrates the lever 23, whose one side is fixed and the other side is a free, to which an external force F applied at the center thereof. The deflection Δ of the lever 23 occurring in this situation is the largest at a position distanced from the free end by a distance L 2. The reactive force R applied to the free end is calculated through the following formula (3), and the dimensions of the lever 23 should be set by ensuring that the lever 23 becomes disengaged from the input shaft 21*b* before the reactive force R exceeds the load limit Sf of the angle sensor 21. In addition, L2 and Δ are calculated through formulae (1) and (2).

$$L2=(1\sqrt{5})\cdot L \tag{1}$$

$$\Delta=(F\cdot L^3)/(48\sqrt{3}\cdot E\cdot I) \tag{2}$$

$$R=(5/16)\cdot F \tag{3}$$

It is to be noted that d represents the wire diameter of the lever 23, L represents the full length of the lever 23, E represents the longitudinal elastic coefficient of the lever 23 and I represents the sectional secondary moment of the lever 23.

Figure 20B:
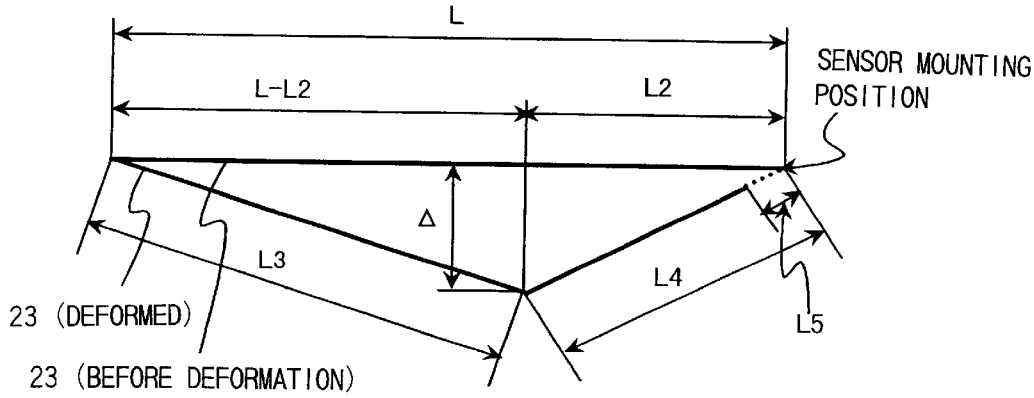
FIG. 20B shows the various dimensions of the lever 23 having undergone deformation.
Figure 20C:
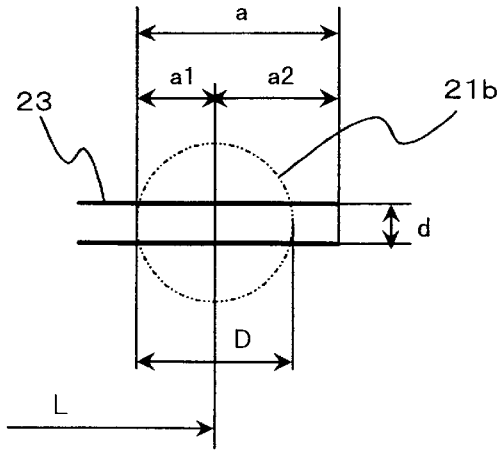
FIG. 20C shows the dimensions of the linking area where the lever 23 and the input shaft 21*b* are linked.

FIG. 20B presents the various dimensions resulting from a deformation of the lever 23 due to the deflection Δ and FIG. 20C shows the dimensions of the linking portion where the lever 23 and the input shaft 21*b* are linked. The individual dimensions L3~L5 in FIG. 20B are calculated through the following formulae (4)~(6);

$$L3=\sqrt{(L-L2)^2+\Delta^2} \tag{4}$$

$$L4=\sqrt{(L2^{2+\Delta^2})} \tag{5}$$

$$L5=L-L3-L4 \tag{6}$$

Namely, by ensuring that (L5+a1) is larger than "a" when the deflection Δ has occurred, the lever 23 is allowed to disengage from the input shaft 21*b*. For instance, the wire diameter d of the lever 23 may be determined in correspondence to the full length L of the lever 23 and the deflection Δ. By setting the full length L and the deflection Δ of the lever 23 at specific values and using those values for L and Δ in the following formula (7) which is obtained from formula (2), for substitution, the cross sectional secondary moment I is calculated. The cross sectional secondary moment I thus calculated is then used for substitution in relational expression (8) expressing the relationship between the wire diameter d and I, and then the wire diameter d is calculated through a reverse operation. Alternatively, the full length L of the lever 23 may be determined in correspondence to the wire diameter d and the deflection Δ of the lever 23.

$$I=(F\cdot L^3)/(48\sqrt{3}\cdot E\cdot \Delta) \tag{7}$$

$$I=(\pi/64)\cdot d^4 \tag{8}$$

Figure 21A:
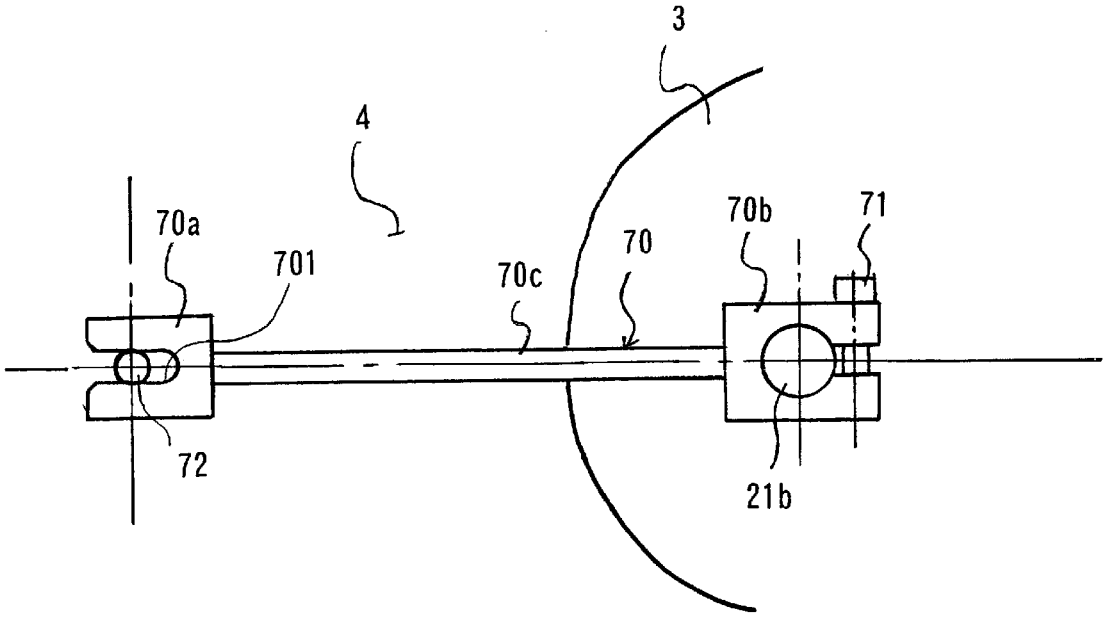
FIG. 21A presents another example in which the link can be released, illustrating a state in which no impact load is applied to the lever 70.
Figure 21B:
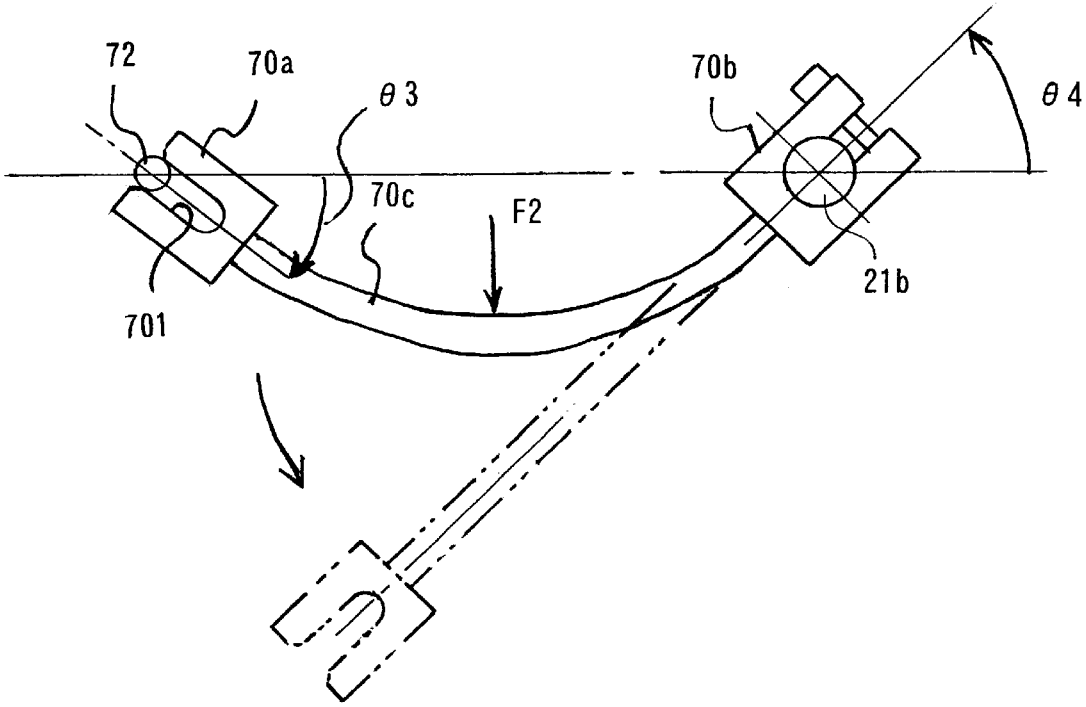
FIG. 21B illustrates a state in which the load F2 is applied in the other example of link which can be released.

While an explanation is given in reference to the embodiment above on an example in which the link between the lever 23 and the input shaft 21*b* is released, the link between the arm 4 and a lever 70 may be released as illustrated in FIGS. 21A and 21B instead. FIG. 21A illustrates a normal state in which the lever 70 constituted of an arm link portion 70*a*, an input shaft securing portion 70*b* and a shaft portion 70*c* formed from piano wire or the like is not subjected to any impact load. An elongated hole 701 is formed at the arm link portion 70*a*. A connector pin 72 provided at the arm 4 is connected at the elongated hole 701 and the lever 70 and the arm 4 are linked each other. The input shaft securing portion 70*b* is secured to the input shaft 21*b* with a bolt 71.

If the load F2 (the force working along the side surface of the boom 3) is applied to the shaft portion 70*c* of the lever 70 as shown in FIG. 21B, the shaft portion 70*c* becomes deformed to bend out downward to cause the input shaft 21*b* to rotate counterclockwise by an angle θ4 and to tilt the arm link portion 70*a* by an angle θ3 relative to the horizontal direction. While the elongated hole 701 of the arm link portion 70*a* is still connected with the pin 22 in this state, the connection of the elongated hole 701 and the pin 72, i.e., the link between the lever 70 and the arm 4, is released, as indicated by the two-point chain line in FIG. 21B if a load any larger than F2 is applied.

Furthermore, the mechanical strength of the lever 23 may be set so as to cause the lever 23 to break (e.g., to undergo plastic deformation or rupture) if a load equal to or exceeding a specific level is applied to the lever 23 to release the link. While it is necessary to replace the broken lever with a new lever, the lever 23 can be reused if the lever 23 is allowed to slip out of the hole H through elastic deformation, as described earlier. However, by allowing the lever 23 to rupture to release the link, the need to form an end of the lever 23 in such a manner that it can slide relative to the input shaft 21*b* is eliminated.

While an explanation is given above in reference to the embodiments on an example in which the present invention is adopted in an angle sensor that detects the angles of the boom 3 and the arm 4 relative to each other, the present invention may be adopted in an angle sensor that detects the boom angle representing the angles of the upper rotating body 1 and the boom 3 of the hydraulic shovel relative to each other or the bucket angle representing the angles of the arm 4 and the bucket 5 relative to each other, an angle sensor that detects the angles of the booms and jibs of various cranes and an angle sensor that detects the angles of articulated arms of an articulated working apparatus.

What is claimed is:

1. A working apparatus for construction machine comprising:

a first member;

a second member rotatably linked with said first member via a linking member provided as an integrated part thereof; and an angle sensor having an input shaft driven to rotate by said first member and a sensor unit for detecting a rotating angle of said input shaft provided inside a case secured to said linking member, that detects a rotating angle of said first member relative to said second member, wherein;

a recessed portion is formed at an end surface of said linking member along an axial direction thereof to house, at least, said case entirely within said recessed portion.

2. A working apparatus for construction machine comprising:

a first member;

a second member rotatably linked with said first member via a linking member provided as an integrated part thereof;

an angle sensor internally provided with a sensor unit for detecting a rotating angle of an input shaft in a case secured to said linking member; and a communicating member that links said first member to said input shaft so as to drive said input shaft to rotate by interlocking with the rotation of said first member, wherein;

(a) a recessed portion is formed at an end surface of said linking member along an axial direction thereof to house said case within said recessed portion; and (b) a projected portion projecting out along an axial direction of said input shaft is provided at an end surface of said case so as to enclose said input shaft outside a movement range of said communicating member.

3. A working apparatus according to claim 2, wherein;

a distance over which said projected portion projects out from the end surface of said linking member along the axial direction thereof is set larger than the distance over which the end surface of said input shaft projects out from the end of the linking member along the axial direction of said input shaft.

4. A working apparatus according to claim 2, wherein;

an input shaft protective cover that covers said input shaft for protection is provided, and said input shaft protective cover and said case are secured to said linking member with a common fastener.

5. A working apparatus according to claim 2, wherein;

a passage for allowing a wiring harness extending from said sensor unit to be drawn out of said recessed portion is formed at said case.

6. A working apparatus according to claim 1, wherein;

a seal member that seals an external circumferential surface of said case and an internal circumferential surface of said recessed portion is provided at said external circumferential surface; and a groove that allows a wiring harness extending from said sensor unit to be drawn out of said recessed portion is formed at said external circumferential surface and a passage for said wiring harness is formed at said seal member at a position aligned with said groove.

7. A working apparatus for construction machine comprising:

a first member;

a second member rotatably linked with said first member via a linking member provided as an integrated part thereof;

an angle sensor having a sensor unit for detecting a rotating angle of an input shaft; and a communicating member that links said first member to said input shaft so as to drive said input shaft of said angle sensor to rotate by interlocking with rotation of said first member and a link between said first member and said input shaft is released when an external force equal to or exceeding a specific level is applied to said communicating member.

8. A working apparatus according to claim 7, wherein;

one end of said communicating member is slidably inserted at a hole formed at said input shaft and another end thereof is secured to said first member, and the mechanical strength of said communicating member and the length over which said communicating member is inserted at said hole are set so as to allow a deformation resulting from an external force equal to or exceeding the specific level applied to said communicating member to cause said one end to slip out of said hole to release the link.

9. A working apparatus according to claim 7, wherein;

the mechanical strength of said communicating member is set so as to cause said communicating member to become broken to release the link between said input shaft and said communicating member when an external force equal to or exceeding the specific level is applied to said communicating member.

10. A working apparatus according to claims 7, wherein;

said angle sensor is provided with a case for housing said input shaft and said sensor unit; and a recessed portion is formed at an end surface of said linking member along an axial direction thereof to house, at least, the said case entirely within said recessed portion.

11. A working apparatus according to claims 7, wherein;

said angle sensor is provided with a case for housing said input shaft and said sensor unit;

(a) a recessed portion is formed at an end surface of said linking member along an axial direction thereof to provide said case in said recessed portion; and (b) a projected portion projecting out along an axial direction of said input shaft is provided at an end surface of said case so as to enclose said input shaft outside the movement range of said communicating member.

12. A working apparatus according to claims 1, wherein;

said first member is an arm and said second member is a boom.

* * * * *